US012523151B2

(12) United States Patent
Wu et al.

(10) Patent No.: US 12,523,151 B2
(45) Date of Patent: Jan. 13, 2026

(54) ASYMMETRIC HYDRAULIC SUPPORTS FOR PSEUDO INCLINED MINING IN STEEPLY DIPPING SEAM

(71) Applicant: XI'AN UNIVERSITY OF SCIENCE AND TECHNOLOGY, Shaanxi (CN)

(72) Inventors: Yongping Wu, Xi'an (CN); Yuqian Du, Xi'an (CN); Panshi Xie, Xi'an (CN); Zhuangzhuang Yan, Xi'an (CN); Tao Hu, Xi'an (CN); Bosheng Hu, Xi'an (CN); Yepeng Tang, Xi'an (CN); Jingyu Huangfu, Xi'an (CN); Tong Wang, Xi'an (CN); Yingrui Xu, Xi'an (CN)

(73) Assignee: XI'AN UNIVERSITY OF SCIENCE AND TECHNOLOGY Xi'an, China, Xi'an (CN)

( * ) Notice: Subject to any disclaimer, the term of this patent is extended or adjusted under 35 U.S.C. 154(b) by 0 days.

(21) Appl. No.: 18/909,929

(22) Filed: Oct. 8, 2024

(65) Prior Publication Data

US 2025/0116192 A1 Apr. 10, 2025

(30) Foreign Application Priority Data

Oct. 8, 2023 (CN) ..... 202311293347.5

(51) Int. Cl.
*E21D 23/04* (2006.01)
*E21D 23/00* (2006.01)
*E21D 23/03* (2006.01)

(52) U.S. Cl.
CPC ..... *E21D 23/04* (2013.01); *E21D 23/0021* (2013.01); *E21D 23/03* (2013.01)

(58) Field of Classification Search
CPC ..... E21D 23/04; E21D 23/0021; E21D 23/03
See application file for complete search history.

(56) References Cited

U.S. PATENT DOCUMENTS 3,488,966 A * 1/1970 Cotterill ..... E21D 23/0047 405/300
3,728,863 A * 4/1973 Hidasi ..... E21D 23/03 405/294

(Continued)

FOREIGN PATENT DOCUMENTS

CN 103397895 A 11/2013
CN 108468560 A 8/2018

(Continued)

OTHER PUBLICATIONS

Xie, Panshi et al., Mechanism and Control Methods of Rib Spalling in Steeply Dipping Thick Seams in Fully-Mechanized Longwall Mining with Large Mining Height, Coal Engineering, 47(1): 74-77, 2015.

(Continued)

*Primary Examiner* — Janine M Kreck
(74) *Attorney, Agent, or Firm* — PORUS IP LLC

(57) ABSTRACT

The embodiments of the present disclosure provide an asymmetric hydraulic support for pseudo inclined mining in steeply dipping seam, wherein the asymmetric hydraulic support includes a top mechanism, a bottom mechanism, a telescopic mechanism, and a connecting mechanism; the top mechanism and the bottom mechanism are disposed in parallel to each other, and a projection of the top mechanism and the bottom mechanism on a working surface is a parallelogram, and a sum of an acute angle of each of two parallelograms and a steeply dipping angle in pseudo inclined mining is 90°; the telescopic mechanism is provided between the top mechanism and the bottom mechanism, and two ends of the telescopic mechanism are rotationally connected to the top mechanism and the bottom mechanism, respectively; one end of the two sets of connecting structures of the connecting mechanism is hinged by a first articulating shaft, and a central axis of the first articulating shaft is located in a middle of the top mechanism and the bottom mechanism, and the other end of each of the two sets of connecting structures is hinged to a first side of the top mechanism and a first side of the bottom mechanism, respectively, by a second articulating shaft; one end of the telescoping structure is hinged to a set of connecting structure which is hinged to the top mechanism, the other end of (Continued)

the telescoping structure is hinged to the bottom mechanism, and a center point of the hinging is coplanar with a vertical bisector of a projection of an edge of the first side of the bottom mechanism on the working surface.

9 Claims, 12 Drawing Sheets

(56) References Cited

U.S. PATENT DOCUMENTS

| | | | | |
|---|---|---|---|---|
| 4,010,618 | A * | 3/1977 | Walker | E21D 23/16 405/290 |
| 10,914,170 | B2 * | 2/2021 | Barbour | E21D 23/0034 |

FOREIGN PATENT DOCUMENTS

| | | | |
|---|---|---|---|
| CN | 109026000 | A | 12/2018 |
| CN | 113565550 | A | 10/2021 |
| CN | 113586106 | A | 11/2021 |
| DE | 3426179 | A1 | 1/1985 |
| SU | 1004651 | A1 | 3/1983 |
| SU | 1627720 | A2 | 2/1991 |

OTHER PUBLICATIONS

First Office Action in Chinese Application No. 202311293347.5 mailed on May 8, 2025, 13 pages.

Notification to Grant Patent Right for Invention in Chinese Application No. 202311293347.5 mailed on May 21, 2025, 4 pages.

* cited by examiner

ASYMMETRIC HYDRAULIC SUPPORTS FOR PSEUDO INCLINED MINING IN STEEPLY DIPPING SEAM

CROSS-REFERENCE TO RELATED APPLICATIONS

This application claims priority of Chinese application No. 202311293347.5, filed on Oct. 8, 2023, the entire contents of which are incorporated herein by reference.

TECHNICAL FIELD

The present disclosure relates to a field of coal mining support, and in particular, relates to an asymmetric hydraulic support for pseudo inclined mining in steeply dipping seam.

BACKGROUND

With high-intensity mining of most of horizontal and near horizontal seam in the continued years, the resource reserve is decreasing, so that coal mining began to shift toward steeply dipping seam with relatively complex occurrence conditions. The steeply dipping seam refers to seam that has a large inclination angle relative to a horizontal surface. Due to constraints of the occurrence condition of the seam, mechanism of rock movement in the steeply dipping seam is complex, coal-forming environment is intricate, and an operational space is limited, making the extraction quite challenging.

At present, a pseudo inclined mining process is usually adopted for the steeply dipping seam, which reduces an inclination angle of a working surface of the steeply dipping seam to a certain extent, and reduces the threat of flying gangue to the equipment and personnel, and is conducive to a stabilization of the coal wall and the control of the coal flow, and simplifies a mining difficulty of the steeply dipping seam. It is beneficial to coal wall stabilization and coal flow control, simplifies the difficulty of mining, and improves the mining efficiency of the steeply dipping seam. However, a working surface arrangement of the pseudo inclined mining and laws of perimeter rock transport have changed greatly, existing hydraulic supports used in the pseudo inclined mining are prone to bracket tail sliding (i.e., tail slip), shifting space, machine roadway spalling and prone to damage, which may affect productivity, be unable to meet the requirements of the steeply dipping seam comprehensive mechanization and even intelligent unmanned mining.

Therefore, it is desired to provide an asymmetric hydraulic support for pseudo inclined mining in steeply dipping seam, which is capable of increasing productivity and reducing the occurrence of risks.

SUMMARY

The embodiments of the present disclosure solve the problem that existing hydraulic supports applied to pseudo inclined mining is prone to bracket tail sliding (i.e., tail slip), shifting space, machine roadway spalling and to damage by providing an asymmetric hydraulic support for pseudo inclined mining in steeply dipping seam. In order to realize above purposes, the embodiments of the present disclosure provide technical solutions comprising:

One or more embodiments of the present disclosure provide an asymmetric hydraulic support for pseudo inclined mining in steeply dipping seam, wherein the asymmetric hydraulic support includes a top mechanism, a bottom mechanism, a telescopic mechanism, and a connecting mechanism; the top mechanism and the bottom mechanism are disposed in parallel to each other, and a projection of the top mechanism and the bottom mechanism on a working surface is a parallelogram, and a sum of an acute angle of each of two parallelograms and a steeply dipping angle in pseudo inclined mining is 90°; the telescopic mechanism is provided between the top mechanism and the bottom mechanism, and two ends of the telescopic mechanism are rotationally connected to the top mechanism and the bottom mechanism, respectively; the connecting mechanism includes a telescopic structure and two sets of connecting structures; one end of each of the two sets of connecting structures is hinged by a first articulating shaft, and a central axis of the first articulating shaft is located in a middle of the top mechanism and the bottom mechanism, and the other end of each of the two sets of connecting structures is hinged to a first side of the top mechanism and a first side of the bottom mechanism, respectively, by a second articulating shaft; one end of the telescoping structure is hinged to a set of connecting structure which is hinged to the top mechanism, the other end of the telescoping structure is hinged to the bottom mechanism, and a center point of the hinging is coplanar with a vertical bisector of a projection of an edge of the first side of the bottom mechanism on the working surface.

In some embodiments, the connecting structure may include a connecting plate and two sets of shelter assemblies. Each set of the two sets of shelter assemblies may include a baffle plate and a plurality of inserting components. The plurality of inserting components may be arranged on one side of the baffle plate. The two sets of shelter assemblies may be arranged on a surface of the connecting plate, with the two baffle plates in the two sets of shelter assemblies being arranged on two sides of the first articulating shaft. A side of one of the two baffle plates on which the inserting components are set may be adjacent to the side of the other baffle plate on which the inserting components are set so that when the two sets of connecting structures are rotated relative to each other, the two baffle plates may move in the direction of the center axis of the first articulating direction, ensuring that the two baffle plates and the connecting plate have no gaps. The combined width of the connecting plate and the two baffle plates along the direction of the center axis of the first articulating shaft may be adapted to the width of the top mechanism.

In some embodiments, each of the plurality of inserting components may include an inserting buckle and an inserting bolt. The inserting bolt may be shaped like a circular arc, and the inner hole shape of the insertion buckle may be adapted to the shape of the inserting bolt. The inserting buckle may be arranged on the connecting plate, and one side of the insertion bolt may be arranged on a side surface of the baffle plate and inserted within the inserting buckle.

In some embodiments, the connecting structure may further include two first side shields. The two first side shields may be arranged on two sides of the articulating shaft, with the surface of each first side shield being perpendicular to the surface of the baffle plate, and each first side shield may be connected to adjacent baffle plates.

In some embodiments, the two sets of connecting structures may be symmetrically disposed with the central axis of the second articulating shaft serving as the axis of symmetry.

In some embodiments, the top mechanism may include a top plate, one or more second side shields, and a first push-pull structure. Each of the two sides of the top plate may be arranged with a second side shield along the axial direction of the second articulating shaft. Each of the one or more second side shields may be equipped with a first push-pull structure to enable the movement of each second side shield on the two sides of the top plate driven by the first push-pull structure.

In some embodiments, the top mechanism may further include a face shield and a second push-pull structure. The face shield may be arranged on a side of the top mechanism opposite to the first articulating shaft, and the second push-pull structure may be connected to the face shield to enable its movement driven by the second push-pull structure.

In some embodiments, the angle between the central axis of the telescopic structure and the bottom surface of the bottom mechanism may be less than or equal to 90°.

In some embodiments, the telescopic structure may be a hydraulic cylinder.

In some embodiments, the bottom mechanism may include a bottom plate, one or more third side shields, and a third push-pull structure. Each of the two sides of the bottom plate may be arranged with a third side shield along the axial direction of the second articulating shaft. Each of the one or more third side shields may be equipped with a third push-pull structure to enable the movement of each third side shield on the two sides of the bottom plate driven by the third push-pull structure.

The beneficial effects provided by the above present disclosure include but are not limited to: (1) because the top mechanism and the bottom mechanism are set in parallel, and a projection of the top mechanism and the bottom mechanism on the working surface is a parallelogram, and a sum of an acute angle of the parallelogram and a steeply dipping angle of the steeply dipping during pseudo inclined mining is 90°, the asymmetric hydraulic support can be completely applicable to the parallelogram space structure of pseudo inclined mining in the steeply dipping seam; (2) when arranged in a straight line, a plurality of asymmetric hydraulic supports are set in a parallelogram, and there is no large gap between the front and back ends of adjacent asymmetric hydraulic support, ensuring stability and avoiding issues such as bracket tail sliding (i.e., tail slip), shifting space, machine roadway spalling and to damage, which may not lead to low productivity of the working surface, and can be able to satisfy the requirements of comprehensive mechanization of the steeply dipping seam and even intelligent and unmanned mining; (3) as the projection of the top mechanism and the bottom mechanism on the working surface is a parallelogram, one end of the two sets of connecting structures of the connecting mechanism is articulated through the first articulating shaft, with the center axis of the first articulating shaft located in the middle of the top mechanism and the bottom mechanism. The center point of the articulation of the telescopic structure articulated with the bottom mechanism is coplanar with the vertical bisector of the side on which the bottom mechanism is located at the first side of the parallelogram. At the same time, the connecting mechanism connects the telescopic structure with the bottom mechanism and the two sets of connecting structures to form a flexible four-link mechanism, which changes the rigid four-link mechanism of the existing asymmetric hydraulic support, ensuring that when the projection of the top mechanism and the bottom mechanism on the working surface is a parallelogram, the top mechanism can perform lifting and lowering movements relative to the bottom mechanism, and the movement always keeps the two parallel; (4) the two sets of connecting structures form a continuous and complete plane, which prevents the issues caused by gaps at the connections of the asymmetric hydraulic support, such as gangue falling into the internal structure of the support in the goaf and the problem of the bracket tail sliding.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
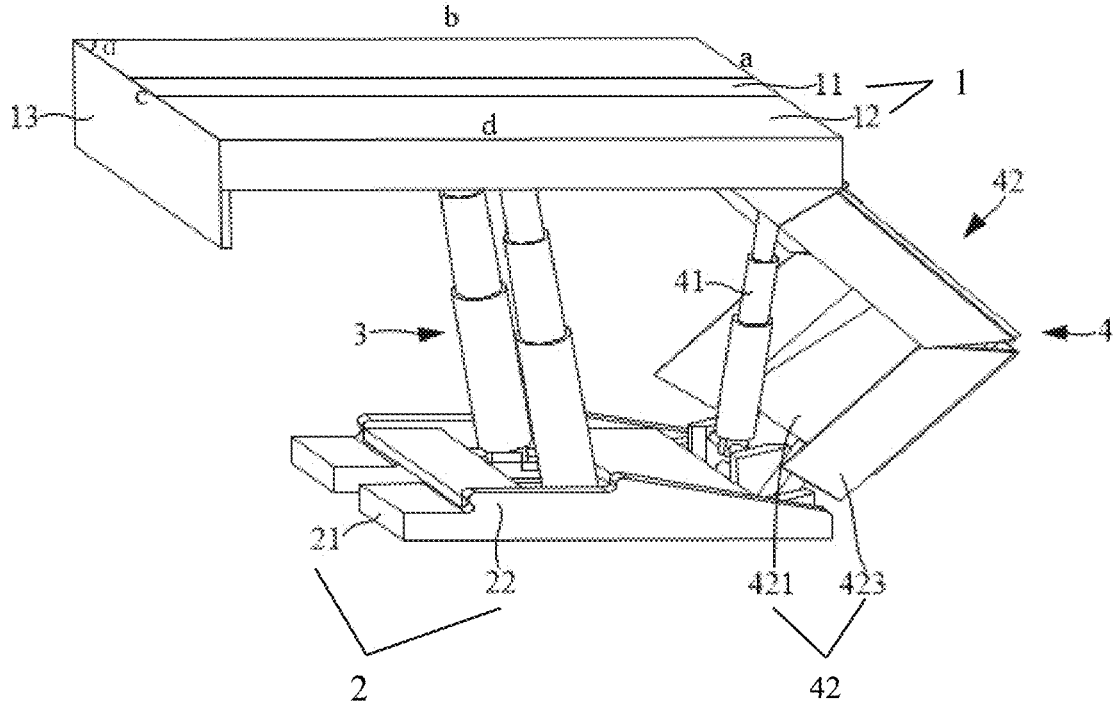
FIG. 1 is a schematic diagram illustrating a single asymmetric hydraulic support for pseudo inclined mining in steeply dipping seam according to some embodiments of the present disclosure.

In the following detailed description, numerous specific details are set forth by way of examples in order to provide a thorough understanding of the relevant disclosure. Obviously, drawings described below are only some examples or embodiments of the present disclosure. Those skilled in the art, without further creative efforts, may apply the present disclosure to other similar scenarios according to these drawings. It should be understood that the purposes of these illustrated embodiments are only provided to those skilled in the art to practice the application, and not intended to limit the scope of the present disclosure. Unless obviously obtained from the context or the context illustrates otherwise, the same numeral in the drawings refers to the same structure or operation.

The terminology used herein is for the purposes of describing particular examples and embodiments only and is not intended to be limiting. As used herein, the singular forms "a," "an," and "the" may be intended to include the plural forms as well, unless the context clearly indicates otherwise. It will be further understood that the terms "include" and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

A pseudo inclined mining process refers to a mining technology for steeply dipping seam. The steeply dipping seam generally refers to seam with a buried dip angle of 35° to 55°, which is a complex and difficult-to-mine seam recognized by the mining community. During a mining process of the steeply dipping seam, debris such as broken coal and gangue is usually loosened and dislodged into the steeply dipping working surface. At this time, due to a large angle of inclination of the seam, the broken coal, gangue, and other debris are affected by gravity and continuously rolled down along the slope, which results in the phenomenon of rolling stone, flying gangue, etc., which causes damage to the operators and equipment. Therefore, when mining of the steeply dipping seam, it is usually necessary to use an asymmetric hydraulic support for the steeply dipping pseudo inclined working surface, and to prevent the broken coal, gangue, and other debris from loosening and falling.

Figure 10:
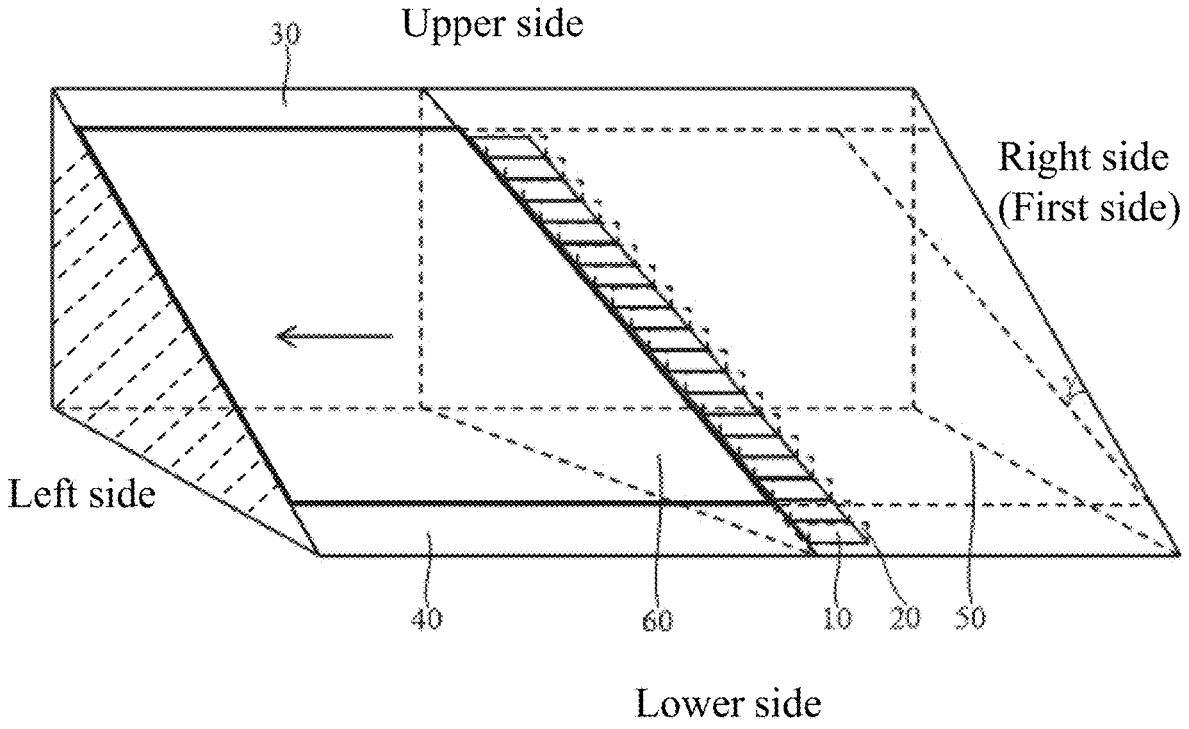
FIG. 10 is a schematic diagram illustrating a three-dimensional structure mining of a steeply dipping pseudo inclined working surface according to some embodiments of the present disclosure.
Figure 11:
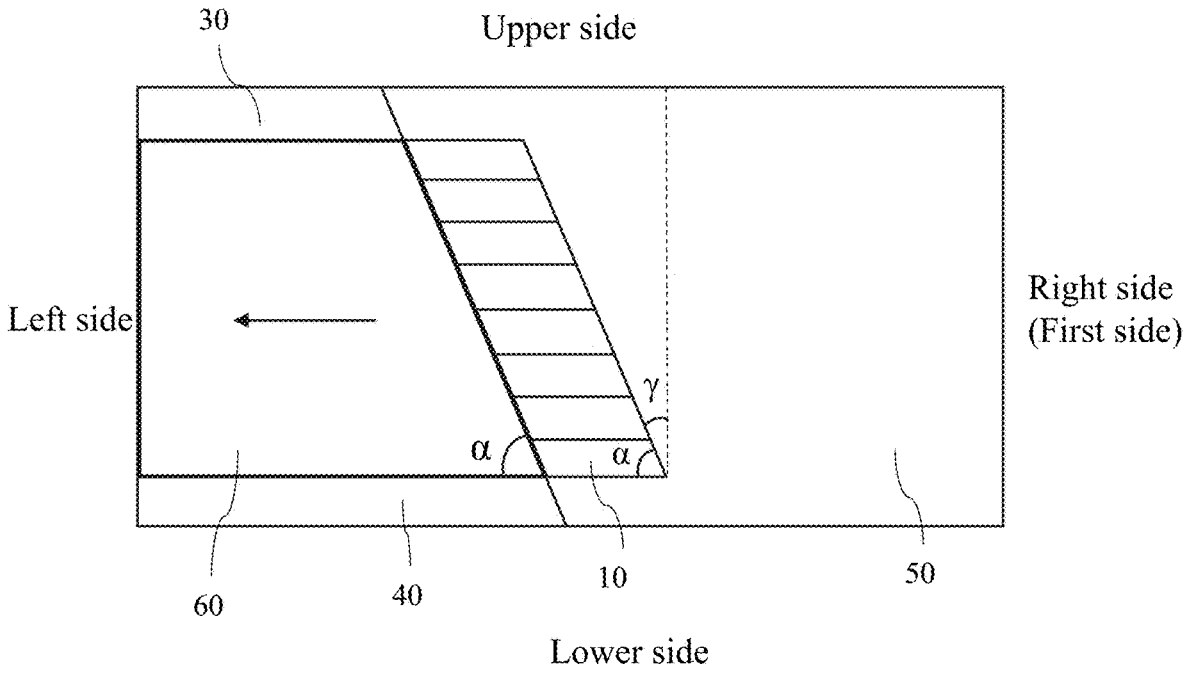
FIG. 11 is a schematic diagram illustrating a planar structure mining of a steeply dipping pseudo inclined working surface according to some embodiments of the present disclosure.

FIG. 10 is a schematic diagram illustrating a three-dimensional structure mining of a steeply dipping pseudo inclined working surface according to some embodiments of the present disclosure. FIG. 11 is a schematic diagram illustrating a planar structure mining of a steeply dipping pseudo inclined working surface according to some embodiments of the present disclosure.

As shown in FIG. 10 and FIG. 11, 10 is an asymmetric hydraulic support proposed in the embodiments of the present disclosure, 20 is an existing asymmetric hydraulic support, and 60 is a working surface. The working surface 60 is a working surface with a certain inclination in a seam mining operation. A plurality of asymmetric hydraulic supports are arranged in a straight-line from high to low along the working surface 60, thereby forming an underground passageway used for the access of personnel and materials. A left side of the working surface 60 is a coal wall, and a right side is an goaf 50, an upper side of the working surface 60 is arranged with a section return airway 30, and a lower side of the working surface 60 is arranged with a section haulage drift 40, and a contact position of the section return airway 30 and the asymmetric hydraulic support is located in the section haulage drift 40. A contact position of the section return airway 30 and the asymmetric hydraulic support is located on a left side of the contact position of the section haulage drift 40 and the asymmetric hydraulic support, and an arrow direction indicated in the figure is a direction of advancement of the working surface 60. A plurality of existing asymmetric hydraulic supports 20 are arranged in a straight-line and set in a ladder shape, and there is usually a large gap between adjacent existing asymmetric hydraulic supports 20, which makes it easy for the bracket tail sliding (i.e., tail slip), shifting space, and machine roadway spalling (i.e., gangue being easy to fall into the internal structure of the asymmetric hydraulic supports from the gaps) and prone to damage (i.e., gangue falling into the internal structure of the asymmetric hydraulic supports from the gaps will smash the internal structure), resulting in low productivity of the working surface, unable to meet the requirements of comprehensive mechanization and even intelligent unmanned mining of steeply dipping seam.

In view of the foregoing, embodiments of the present disclosure provide an asymmetric hydraulic support 10 for pseudo inclined mining in steeply dipping seam, the asymmetric hydraulic support 10 is arranged in a straight-line when arranged and set up on the working surface 60, so that the two adjacent asymmetric hydraulic supports 10 are closely fitted to each other, thereby effectively reducing the gap between adjacent asymmetric hydraulic supports 10. The problem that the existing asymmetric hydraulic support applied to pseudo inclined mining is prone to bracket tail sliding (i.e., tail slip), shifting space, machine roadway spalling and prone to damage is solved. More descriptions of the asymmetric hydraulic support for pseudo inclined mining in steeply dipping seam may be found in FIG. 1-FIG. 9 and the related descriptions.

Figure 2:
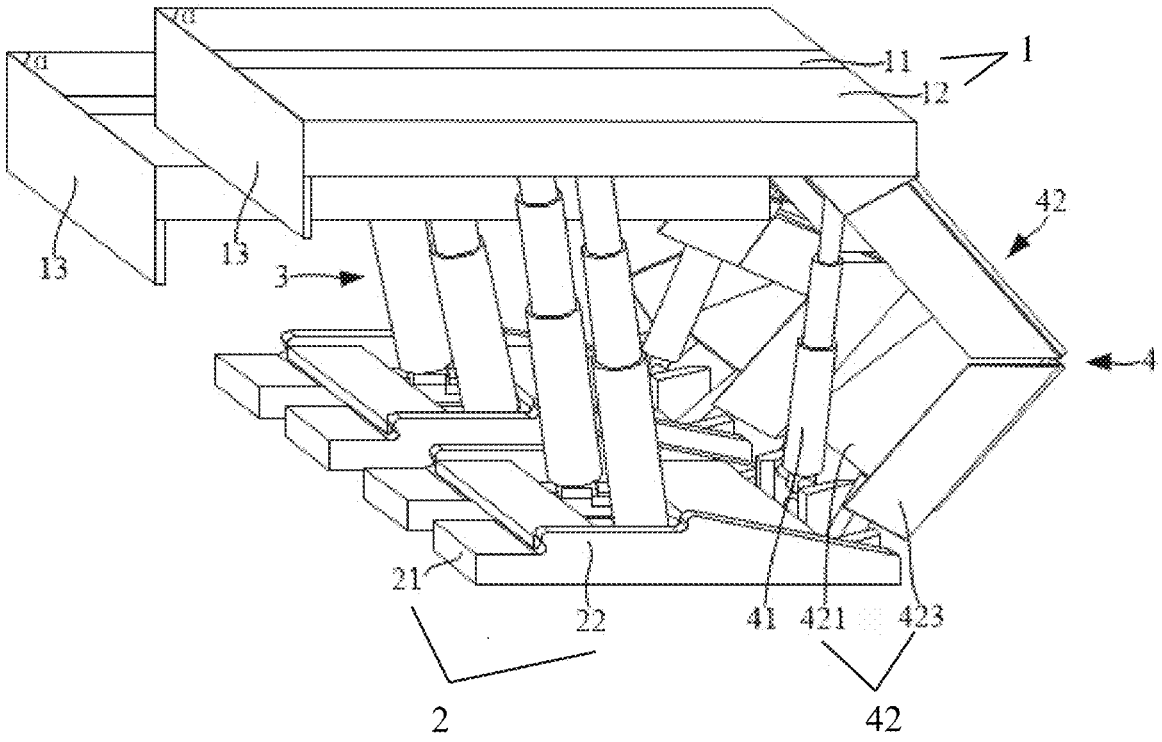
FIG. 2 is a schematic structural diagram illustrating a structure of straight-line arrangement of two asymmetric hydraulic supports for pseudo inclined mining in steeply dipping seam according to some embodiments of the present disclosure.

FIG. 1 is a schematic diagram illustrating a single asymmetric hydraulic supports for pseudo inclined mining in steeply dipping seam according to some embodiments of the present disclosure; FIG. 2 is a schematic structural diagram illustrating a structure of straight-line arrangement of two asymmetric hydraulic supports for pseudo inclined mining in steeply dipping seam according to some embodiments of the present disclosure.

In some embodiments, as shown in FIG. 1 and FIG. 2, the asymmetric hydraulic support 10 includes a top mechanism 1, a bottom mechanism 2, a telescopic mechanism 3, and a connecting mechanism 4.

FIG. 2 is a schematic structural diagram illustrating a structure of straight-line arrangement of two asymmetric hydraulic supports for pseudo inclined mining in steeply dipping seam according to some embodiments of the present disclosure. As shown in FIG. 2, the two asymmetric hydraulic supports are arranged in a straight-line in such a way that the two asymmetric hydraulic supports 10 are aligned in a direction perpendicular to a center axis of an articulating shaft (e.g., a first articulating shaft 43 or a second articulating shaft 44) of the asymmetric hydraulic support 10. It may be understood that when the count of asymmetric hydraulic supports 10 laid on the working surface 60 are arranged in a straight-line according to the foregoing arrangement direction, an underground passageway accessed by personnel and materials is formed on the working surface 60.

The top mechanism 1 is a device for preventing dislodging of broken coal and debris such as gangue. An upper part of the top mechanism 1 is in direct contact with the seam and transmits the pressure to the jacks or columns, thus protecting the working space of the working surface.

In some embodiments, the top mechanism 1 includes a top plate 11. The top plate 11 is a plate-like structure provided parallel to the working surface 60, or the like. For example, the top plate 11 is a plate-like structure in the shape of a parallelogram set parallel to the working surface 60.

In some embodiments, the top mechanism 1 further includes a top plate, a second side shield, and a first push-pull structure. More descriptions of the embodiment may be found in the related descriptions below The bottom mechanism 2 is a device for supporting and securing the entire asymmetric hydraulic support.

In some embodiments, the bottom mechanism 2 includes a bottom plate 21. For example, the bottom plate 21 is a plate-like structure arranged parallel to the working surface 60. For example, the bottom plate 21 is a plate-like structure in the shape of a parallelogram that is parallel to the working surface 60.

In some embodiments, the bottom mechanism 2 further includes a bottom plate, a third side shield, and a third push-pull structure. More descriptions of the embodiment may be found in the related descriptions below.

In some embodiments, as shown in FIG. 1, FIG. 2, and FIG. 11, the top mechanism 1 and the bottom mechanism 2 are provided in parallel with each other, and the projection of the top mechanism 1 and the bottom mechanism 2 on the working surface 60 is a parallelogram, and a sum of the acute angle $\alpha$ and the steeply dipping angle $\gamma$ in pseudo inclined mining is 90°. The steeply dipping angle $\gamma$ varies with the need for mining, and the acute angle $\alpha$ varies.

The steeply dipping angle $\gamma$ is an angle between an alignment direction of the plurality of asymmetric hydraulic supports aligned in a straight-line and a plumb line from the haulage drift 40 to the return airway 30 of the zone. As shown in FIG. 11, in order to mine the steeply dipping seam, the asymmetric hydraulic support laid in a straight-line is not parallel to the plumb line from the haulage drift 40 to the return airway 30, but has an angle $\gamma$. Compared to the straight-line arrangement process of laying the asymmetric hydraulic support along the vertical line from the haulage drift 40 to the return airway 30, the straight-line arrangement process with a steeply dipping angle $\gamma$ is adapted to a certain extent slow down the inclination angle of the working surface 60 in comparison with the surface water plane, which can reduce the difficulty of mining, and improve the safety in the process of mining operations.

Since the top mechanism 1 and the bottom mechanism 2 are set parallel to the working surface 60, a projected shape of the top mechanism 1 on the working surface 60 may be the same as a projected shape of the top plate 11, and a projected shape of the bottom mechanism 2 on the working surface 60 may be the same as a shape of the bottom plate 21. For example, when the top plate 11 is set as a parallelogram, the projected shape of the top mechanism 1 on the working surface is a parallelogram; when the bottom plate 21 is set as a parallelogram, the projected shape of the bottom mechanism 2 on the working surface is a parallelogram.

In some embodiments, the projected shape of the bottom mechanism 2 on the working surface 60 may be included in the projected shape of the top mechanism 1 on the working surface 60.

In some embodiments, a projected position of the first side of the top mechanism 1 coincides with a projected position of the first side of the bottom mechanism 2. The first side of the top mechanism 1 is a side on which the second articulating shaft is provided, and the first side of the bottom mechanism 2 is a side on which the other second articulating shaft is provided. More descriptions of the second articulating shaft may be found in the related description later.

As shown in FIG. 1, a, b, c, and d correspond to four sides of the parallelogram, wherein a and c are short sides of the parallelogram, and b and d are long sides of the parallelogram. The parallelogram abcd is a projected shape of the top mechanism 1 on the working surface 60, and the projected shape of the bottom mechanism 2 on the working surface 60 may be contained in the parallelogram abcd. The side a of the parallelogram is a projection of a first side of the top mechanism 1 on the working surface 60. The projection of the second side of the bottom mechanism 2 on the working surface 60 is the side a of the parallelogram, or it may be a line segment at the same position as the side a of the parallelogram with a length less than the side a of the parallelogram.

In some embodiments of the present disclosure, the asymmetric hydraulic supports 10 are set in a parallelogram shape when set up in a straight-line arrangement, which can reduce the gap between the front end and the rear end of the adjacent asymmetric hydraulic supports 10. By setting the projection of the top mechanism 1 at the working surface 60 in the form of a parallelogram, it is possible to support the coal wall and the top plate 11 of the working surface in a complete fit, avoiding overhanging of the coal wall and the top plate 11, and effectively preventing the phenomena such as a roof fall in front of the support and the occurrence of the coal wall sheet ganging. By setting the projection of the bottom mechanism 2 in the working surface as a parallelogram and the coal wall of the working surface, it is favorable to provide sufficient working space for the scraper conveyor and the coal mining machine.

The telescopic mechanism 3 is a device for adjusting a height of the asymmetric hydraulic support 10, and by adjusting the height of the support, it is possible to adapt the asymmetric hydraulic support 10 to different thicknesses of seam and working surfaces.

In some embodiments, the telescopic mechanism 3 includes at least one jack or at least one hydraulic column. As shown in FIG. 1, the telescopic mechanism 3 includes two hydraulic columns.

In some embodiments, the telescopic mechanism 3 is provided between the top mechanism 1 and the bottom mechanism 2, and the two ends are rotationally connected to the top mechanism 1 and the bottom mechanism 2, respectively, as illustrated in FIG. 1 and FIG. 2.

In some embodiments, two ends of the telescopic mechanism 3 are hinged to the top mechanism 1 and the bottom mechanism 2, respectively, via pins or column nests. When the two ends of the telescopic mechanism 3 are hinged to the top mechanism 1 and the bottom mechanism 2, respectively, via a pin, the axes of the pins are oriented perpendicularly to the side b or side d of the parallelogram.

When the telescopic mechanism 3 includes two or more hydraulic columns, a connecting line of the center axis of the two or more hydraulic columns is parallel to the side a or side c of the parallelogram. When the plurality of asymmetric hydraulic supports 10 are arranged in a straight-line array along the pseudo inclined working surface for support, the lines of the center axis of the hydraulic columns of the telescopic mechanism 3 are located in the same straight-line and are parallel to the a-side or c-side of the parallelogram.

In some embodiments of the present disclosure, the arrangement of the hydraulic column of the telescopic mechanism 3 described above can make the tail of the asymmetric hydraulic support 10 less likely to buckle, thereby ensuring uniform load distribution of the top mechanism 1 and increasing the stability of the asymmetric hydraulic support 10; and when the plurality of asymmetric hydraulic supports 10 are neatly arranged in sequence, a passageway is formed for operators to walk and move, which can be used as an emergency evacuation channel for the operator when an unexpected accident occurs, providing protection for the personal safety of the operator.

The connecting mechanism 4 is a device for connecting different components of the asymmetric hydraulic support 10. For example, the connecting mechanism 4 is used to connect the top mechanism 1 and the bottom mechanism 2. In some embodiments, as shown in FIG. 1 and FIG. 2, the connecting mechanism 4 includes a telescopic structure 41 and two sets of connecting mechanisms 42.

The telescopic structure 41 is a device for connecting the top mechanism 1 and the bottom mechanism 2. The telescopic structure 41 has a telescopic function and is capable of lifting and lowering in conjunction with the telescopic mechanism 3, which ensures that the top mechanism 1 and the bottom mechanism 2 are kept parallel during the lifting and lowering process.

In some embodiments, the telescopic structure 41 is a hydraulic cylinder. The hydraulic cylinder is a hydraulic actuator that can convert hydraulic energy into mechanical energy and perform straight-line reciprocating motion (or swing motion).

In some embodiments of the present disclosure, the hydraulic cylinder has a simple structure and reliable operation, and when it is used to realize the reciprocating motion, it can be free of a deceleration device, there is no transmission gap, and the motion is smooth.

Figure 5:
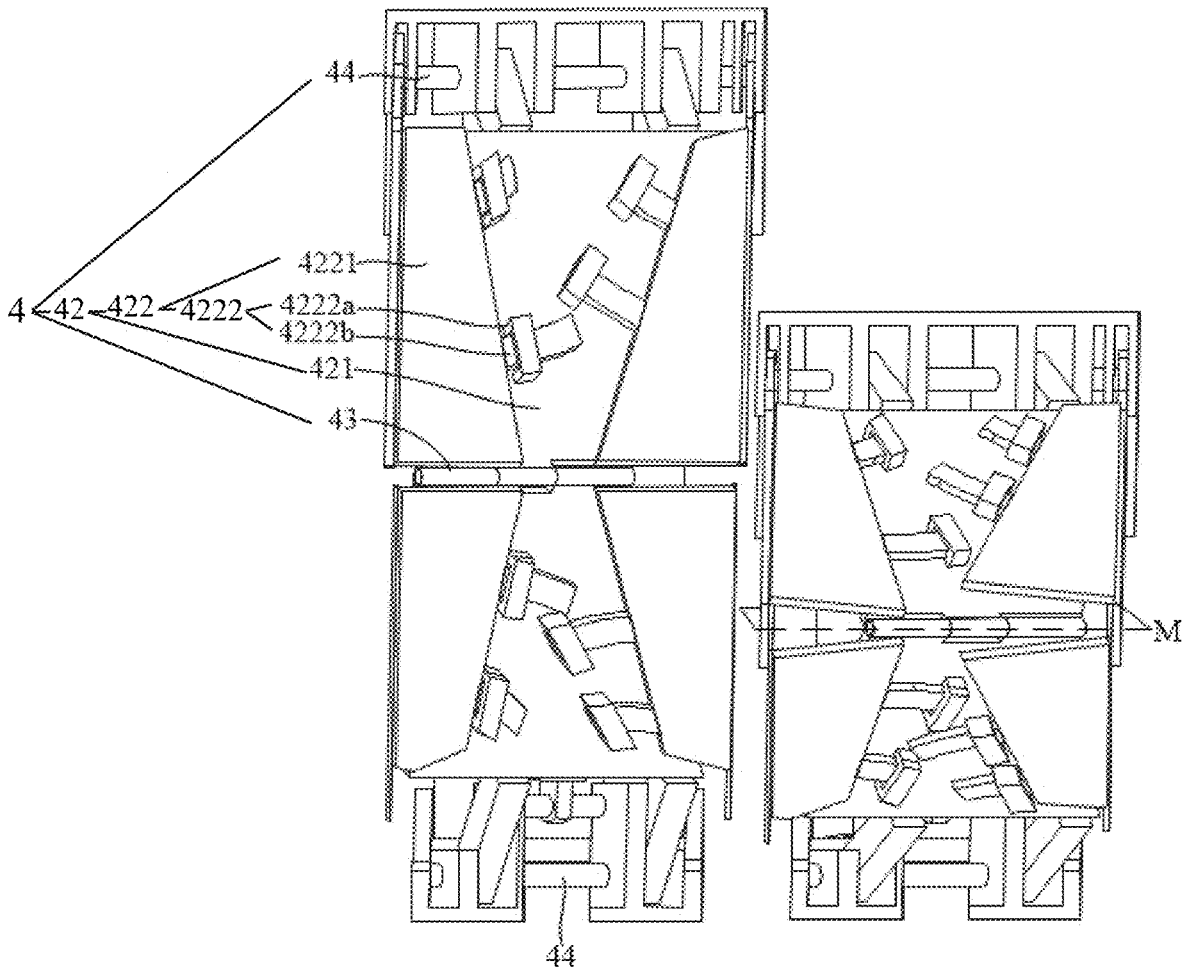
FIG. 5 is a right view illustrating a straight-line arrangement of two asymmetric hydraulic supports for pseudo inclined mining in steeply dipping seam according to some embodiments of the present disclosure.

In some embodiments, one end of the two sets of connecting structures 42 is hinged together by a first articulating shaft 43, and a center axis of the first articulating shaft 43 is located at a middle position between the top mechanism 1 and the bottom mechanism 2, as shown in FIG. 5. The other end of one set of connecting structures 42 (hereafter referred to as the first connecting structures) is hinged to the first side of the top mechanism 1 by a second articulating shaft 44 and the other end of the other set of connecting structures 42 (hereafter referred to as the second connecting structures) is hinged to the first side of the bottom mechanism 2 by another second articulating shaft 44.

The first articulating shaft 43 is an articulating shaft for connecting the first connecting structure and the second connecting structure. The second articulating shaft 44 is an articulating shaft that connects the two sets of connecting structures to the top mechanism 1 and the bottom mechanism 2, respectively.

In some embodiments, as shown in FIG. 1, FIG. 2, and FIG. 5, the center axis of the first articulating shaft 43 is located on a mid-plane M at a distance equal to a top surface of the top mechanism 1 (i.e., an upper surface of the top plate 11 of the top mechanism 1) and to a bottom surface of the bottom mechanism 2 (i.e., a lower surface of the bottom plate 21 of the top mechanism 2), and when the top mechanism 1 performs the lifting and lowering motion relative to the bottom mechanism 2, the center axis of the first articulating shaft 43 is located in real time on the mid-plane M at a distance equal to the top surface of the top mechanism 1 and to the bottom surface of the bottom mechanism 2. It may be appreciated that during the lifting and lowering movement of the top mechanism 1 with respect to the bottom mechanism 2, the position of the center axis of the first articulating shaft 43 changes in real time to remain in the mid-plane M where the top surface of the top mechanism 1 is at a distance equal to the distance to the bottom surface of the bottom mechanism 2.

Figure 4:
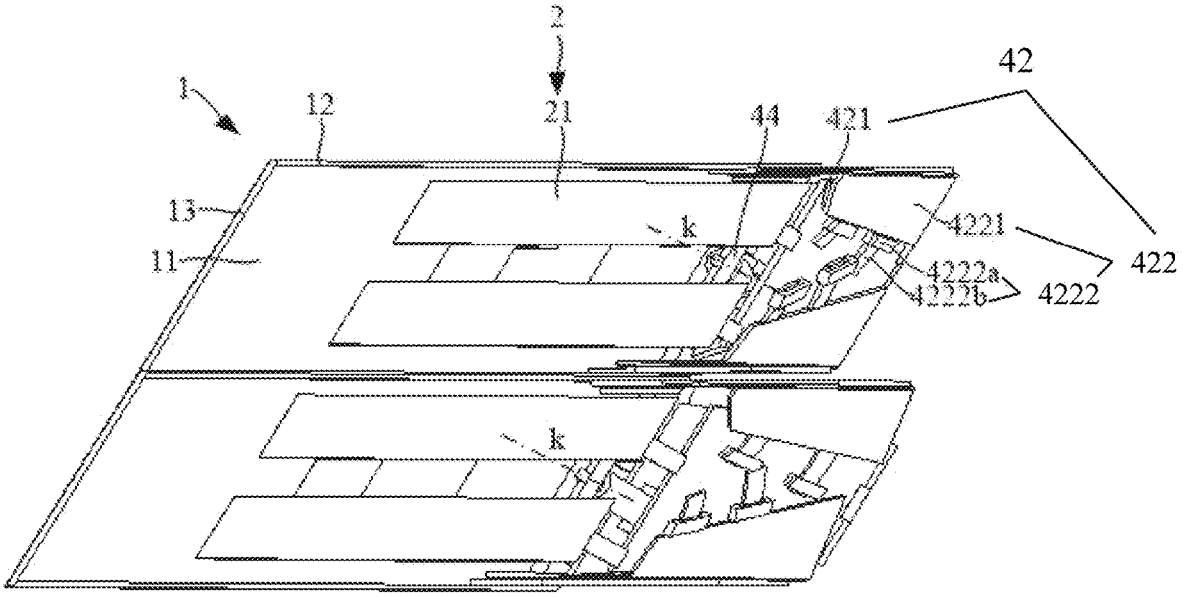
FIG. 4 is an upward view illustrating a straight-line arrangement of two asymmetric hydraulic supports for pseudo inclined mining in steeply dipping seam according to some embodiments of the present disclosure.
Figure 6:
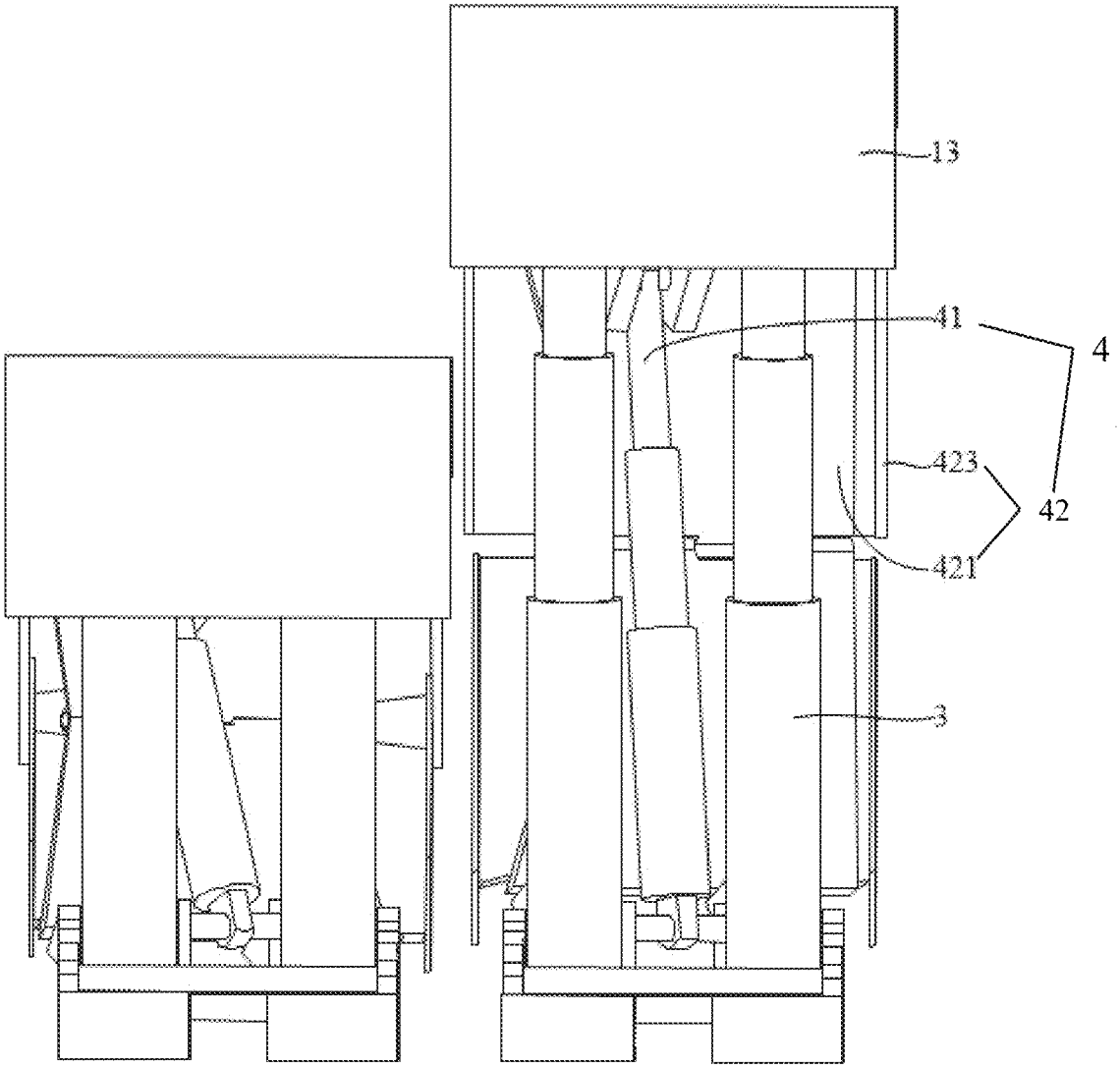
FIG. 6 is a left view illustrating a straight-line arrangement of two asymmetric hydraulic supports for pseudo inclined mining in steeply dipping seam according to some embodiments of the present disclosure.

In some embodiments, as shown in FIG. 4 and FIG. 6, one end of the telescopic structure 41 is hinged to the connecting structure 42 (i.e., a first connecting structure) hinged to the top mechanism 1, and the other end of the telescopic structure 41 is hinged to the bottom mechanism 2, and the two hinged center points are coplanar with the vertical bisector k of the sides (e.g., the side a of FIG. 1) of the first side of the bottom mechanism 2 in the projected surface of the working surface. The two articulation center points include a center point at which one end of the telescopic structure 41 is articulated with the first articulating shaft 43 and a center point at which the other end of the telescopic structure 41 is articulated with the bottom mechanism 2.

In some embodiments, as shown in FIG. 5, the two sets of connecting structures 42 are disposed at an incline with respect to the top mechanism 1 and the bottom mechanism 2, respectively (i.e., the planes in which the two sets of connecting structures 42 are disposed are not parallel to the planes of the top mechanism 1 and the bottom mechanism 2), and the two sets of connecting structures 42 may be formed to succeed one another in a complete planar surface. More descriptions of the two sets of connecting structures 42 forming a succession of complete planes may be found in FIG. 3-FIG. 5, FIG. 7, and related descriptions.

In some embodiments of the present disclosure, the two sets of connecting structures 42 form a succession of complete planes, which avoids the problem of impacts and sliding of the tail of the asymmetric hydraulic support 10 due to the existence of gaps at the connection of the asymmetric hydraulic support, and the gangue in the mining area 50 falling to the inside of the structure of the asymmetric hydraulic support itself, and the problem of the tail slide of the asymmetric hydraulic support 10.

In some embodiments of the present disclosure, the asymmetric hydraulic support 10 for pseudo inclined mining in steeply dipping seam is provided such that, because the top mechanism 1 and the bottom mechanism 2 are set in parallel with each other, and the projection of the top mechanism 1 and the bottom mechanism 2 on the working surface 60 is a parallelogram, the sum of the acute angle $\alpha$ of the parallelogram and the steeply dipping angle $\gamma$ of the pseudo inclined mining is 90°, so that the asymmetric hydraulic support 10 can be completely applicable to the parallelogram spatial structure in the pseudo inclined mining of the steeply dipping seam, so that the plurality of asymmetric hydraulic supports 10 are set in parallelograms in a straight-line arrangement, and the neighboring asymmetric hydraulic supports 10 can be tightly adhered to one another, thus effectively reducing the gaps between neighboring asymmetric hydraulic supports 10. The support of the asymmetric hydraulic support 10 is stable, avoiding the problems of bracket tail sliding (i.e., tail slip), shifting space, machine roadway spalling, and prone to damage of the asymmetric hydraulic support 10, which in turn will not lead to low productivity of the working surface, and it can meet the requirements of comprehensive mechanization and even intelligent unmanned mining of the steeply dipping seam. Because the projection of the top mechanism 1 and the bottom mechanism 2 on the working surface 60 is a parallelogram, one end of the two sets of connecting structures 42 of the connecting mechanism 4 is hinged by the first articulating shaft 43, and the center axis of the first articulating shaft 43 lies between the top mechanism 1 and the bottom mechanism 2. The center axis of the first articulating shaft 43 is located in the middle position of the top mechanism 1 and the bottom mechanism 2, and the articulation center point of the telescopic structure 41 articulated with the bottom mechanism 2 is coplanar with the vertical bisector of the side on which the first side of the bottom mechanism 2 is located in the parallelogram, and at the same time, the telescopic structure 41 in the connecting mechanism 4, with the bottom mechanism 2 and the two sets of connecting structures 42 forming a flexible four-link, which has changed the structure of the existing rigid four-link of the hydraulic support 20, and is able to ensure that when the projection of the top mechanism 1 and the bottom mechanism 2 on the working surface is a parallelogram, the top mechanism 1 is able to do lifting movements relative to the bottom mechanism 2, and the movement always keeps the two parallel at the same time.

Figure 3:
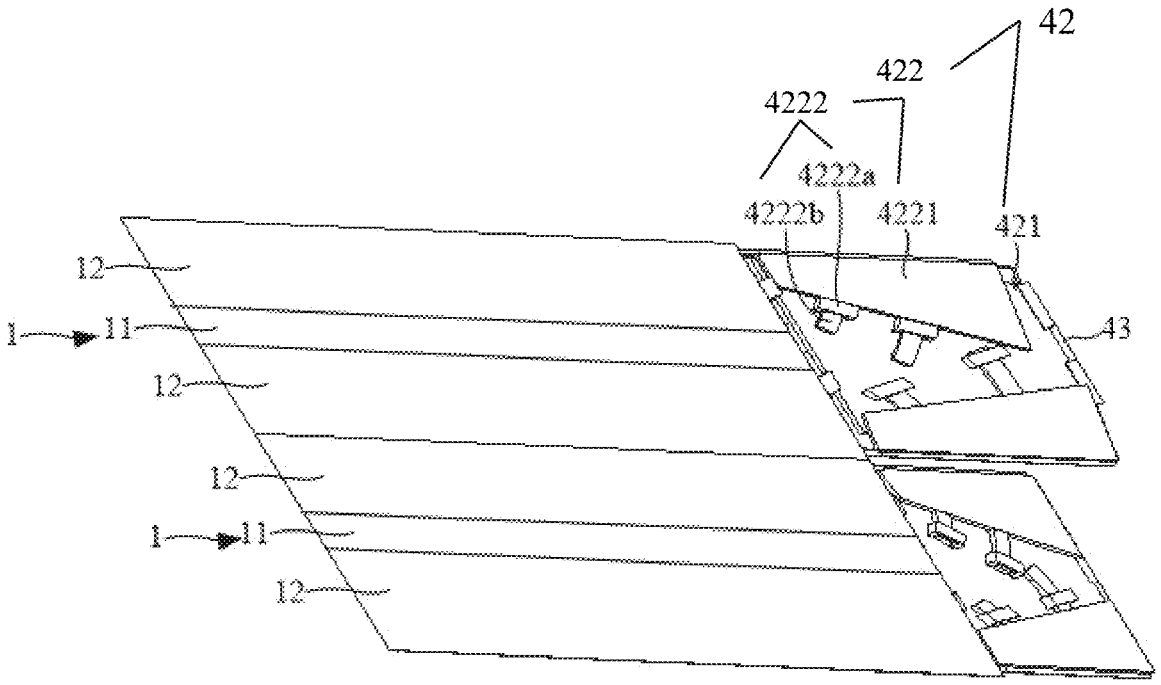
FIG. 3 is a top view illustrating a straight-line arrangement of two asymmetric hydraulic supports for pseudo inclined mining in steeply dipping seam according to some embodiments of the present disclosure.
Figure 7:
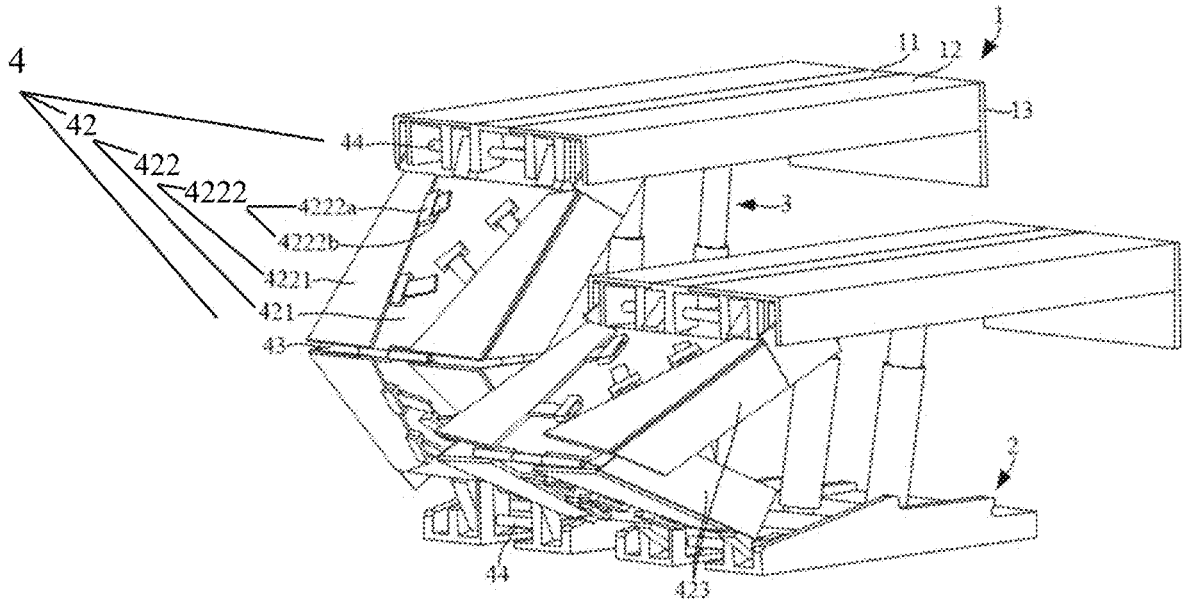
FIG. 7 is another schematic diagram illustrating a structure of a straight-line arrangement of two asymmetric hydraulic supports for pseudo inclined mining in steeply dipping seam according to some embodiments of the present disclosure.
Figure 8:
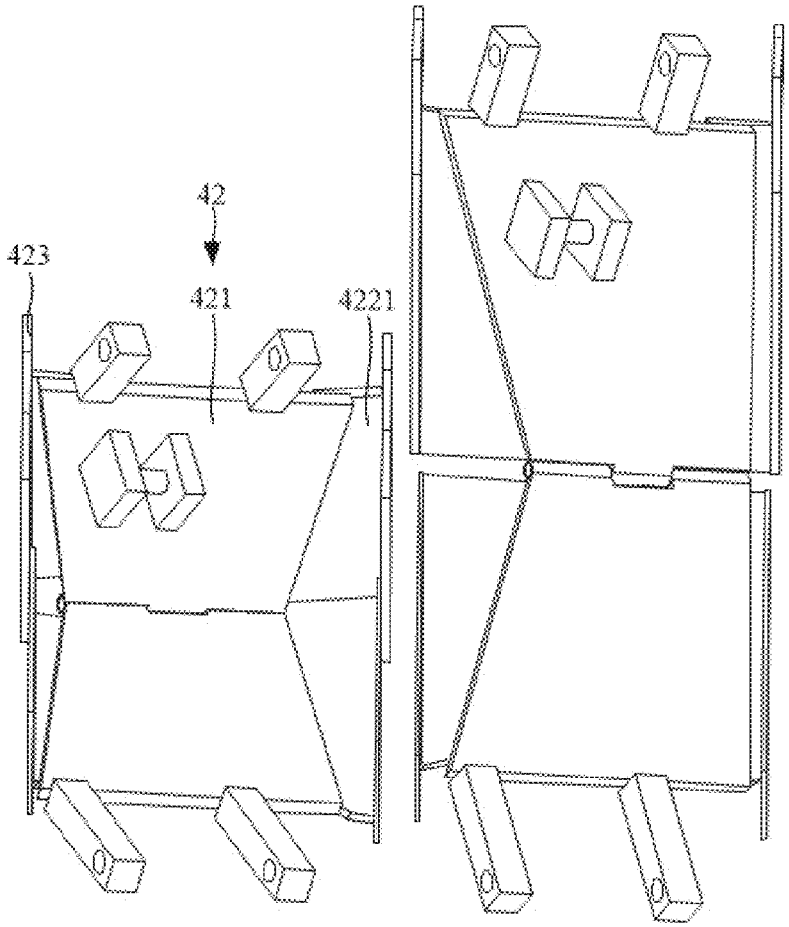
FIG. 8 is a schematic diagram illustrating a portion of a connecting structure according to some embodiments of the present disclosure.

FIG. 3 is a top view illustrating a straight-line arrangement of two asymmetric hydraulic supports for pseudo inclined mining in steeply dipping seam according to some embodiments of the present disclosure; FIG. 4 is an upward view illustrating a straight-line arrangement of two asymmetric hydraulic supports for pseudo inclined mining in steeply dipping seam according to some embodiments of the present disclosure; FIG. 5 is a right-hand view illustrating a straight-line arrangement of two asymmetric hydraulic supports for pseudo inclined mining in steeply dipping seam according to some embodiments of the present disclosure; and FIG. 7 is another schematic diagram illustrating a structure of a straight-line arrangement of two asymmetric hydraulic supports for pseudo inclined mining in steeply dipping seam according to some embodiments of the present disclosure.

In some embodiments, as shown in FIG. 3-FIG. 5, FIG. 7, the connecting structure 42 includes a connecting plate 421 and two sets of shelter assemblies 422.

The connecting plate 421 is a main part of connecting structure 42. The connecting plate 421 is a plate-like structure. In some embodiments, the connecting plate 421 is provided as a plate-like structure in a shape of an irregular quadrilateral. A side of the connecting plate 421 of the first connecting structure is hinged to the bottom mechanism 2 via a second articulating shaft 44, and a side edge of the connecting plate 421 of the second connecting structure is hinged to the bottom mechanism 2, the opposite other side of the connecting plate 421 of the first connecting structure is hinged to the opposite other side of the connecting plate 421 of the second connecting structure is hinged to the bottom mechanism 2 by the first articulating shaft 43.

The shelter assembly 422 is a structure for shading an edge portion of the connecting plate 421. The edge portion of the connecting plate 421 includes portions disposed in regions on either side of the first articulating shaft 43. The shelter assembly 422 is disposed at an edge on the connecting plate 421 adjacent to an edge connecting the first articulating shaft 43 or the second articulating shaft 44.

In some embodiments, the shelter assembly 422 includes a baffle plate 4221 and a plurality of inserting components 4222. The baffle plate 4221 is a plate-like structure. In some embodiments, the baffle plate 4221 is provided as a plate-like structure in the shape of an irregular quadrilateral. One side of the baffle plate 4221 may be hinged to a side shield 423. The other side of the baffle plate 4221 is slidably connected to the connecting plate 421 via the inserting component 4222. When the hydraulic support is raised or lowered, the position of the connecting plate 421 changes, and at this time, the two baffle plates 4221 are able to move in a direction of the center axis of the first articulating shaft 43, ensuring that the baffle plates 4221 and the connecting plate 421 are always free of gaps.

The inserting component is a component used to prevent the baffle plate 4221 from falling off. More descriptions of the inserting component may be found in the related description later.

In some embodiments, the plurality of inserting components 4222 are provided on one side of the baffle plate 4221. For example, the inserting component 4222 is provided on an upper surface of the baffle plate 4221 (i.e., a side of the baffle plate 4221 that faces the connecting plate 421) or on a lower surface of the baffle plate 4221 (i.e., a side of the baffle plate 4221 that is backed away from the connecting plate 421).

In some embodiments, for each connecting structure 42, two sets of baffle plates 422 contained therein are provided on the surface of the connecting plate 421, and two baffle plates 4221 in the two sets of baffle plates 422 are provided on both sides of the center axis of the first articulating shaft 43, and one side of the two baffle plates 4221 on which the inserting components 4222 are provided is adjacent to the other side of the baffle plates 4221, so that when the two connecting structures 42 are rotated relative to each other, the two baffle plates 4221 are able to move in the direction of the center axis of the first articulating shaft 43 so that there is always no gap between the baffle plate 4221 and the connecting plate 421, and so that a width (e.g., the sum of the widths of the two baffle plates 4221) of the connecting plate 421 and the two baffle plates 4221 in the direction of the center axis of the articulating shaft (e.g., the first articulating shaft 43) is adapted to the width of the top mechanism 1. For example, the width adaption is a sum of the width of the connecting plate 421 along the direction of the center axis of the first articulating shaft and the width of the two baffle plates 4221 along the direction of the center axis of the first articulating shaft is the same as the width of the top mechanism 1 along the direction of the center axis of the first articulating shaft. As another example, the width adaption is a sum of the width of the connecting plate 421 in the direction along the center axis of the first articulating shaft and the width of the two baffle plates 4221 in the direction along the center axis of the first articulating shaft is less than the sum of the width of the top mechanism 1 in the direction along the center axis of the first articulating shaft.

In some embodiments of the present disclosure, the first connecting structure contains one side of both baffle plates 4221 (e.g., a side adjacent to a side on which the plurality of inserting components 4222 are provided) connected to the top mechanism 1, and the second connecting structure contains one side of both baffle plates 4221 (e.g., a side adjacent to a side on which the plurality of inserting components 4222 are provided) connected to the bottom mechanism 2. The side on the baffle plate 4221 that is connected to the top mechanism 1 or the bottom mechanism 2 may be referred to as a connecting side of the baffle plate 4221. The side opposite the connecting side of the baffle plate 4221 is proximate to the first articulating shaft 43, but not fixedly connected to the first articulating shaft 43.

In some embodiments of the present disclosure, the two baffle plates 4221 in the set of connecting structures 42 are disposed on either side of the center axis of the first articulating shaft 43 but are not fixedly connected to the first articulating shaft 43. For example, the connecting sides of the two baffle plates 4221 in the first connecting structure are each fixedly connected to both sides of the first side of the top mechanism 1 along the center axis of the second articulating shaft 44, such that the two baffles in the first connecting structure opposing sides of the connecting sides of the first connecting structure 4221 are each located on both sides of the center axis of the first articulating shaft 43, but are not fixedly connected to the first articulating shaft 43.

In some embodiments of the present disclosure, a perpendicular distance between a connecting side of the baffle plate 4221 and an opposing side of that connecting side is greater than or equal to a length of the connecting plate 421 along a direction perpendicular to a center axis of the first articulating shaft 43.

In some embodiments of the present disclosure, for each of the connecting structures 42, the two baffle plates 4221 of the two sets of baffle plates 422 contained therein are each slidably interfitting connected to the connecting plate 421 via the plurality of inserting components 4222. The manner in which the baffle plate 4221 is slidably interfitting connected to the connecting plate 421 by the inserting component 422 enables the opposing sides of the connecting side of the baffle plate 4221 to move in the direction of the center axis of the first articulating shaft 43, which in turn allows the baffle plate 4221 to be always gapless with the connecting plate 421.

When the two sets of connecting structures 42 are rotated relative to each other, the position of the first articulating shaft 43 changes, but the center axis of the first articulating shaft 43 is always maintained at the middle position of the top mechanism 1 and the bottom mechanism 2.

In some embodiments of the present disclosure, the inserting component 4222 may be in any structural form that allows the baffle plate 4221 to achieve a slidable insertion connection with the connecting plate 421.

In some embodiments of the present disclosure, as shown in FIG. 3~FIG. 5 and FIG. 7, the inserting component 4222 includes an inserting buckle 4222*a* and an inserting bolt 4222*b*. The inserting bolt 4222*b* may be curved, and the shape of the bore of the inserting buckle 4222*a* is adapted to the shape of the inserting bolt 4222*b*. The inserting buckle 4222*a* and the inserting bolt 4222*b* are mounted on the connecting plate 421 and on the baffle plate 4221, respectively, so as to achieve a slidable insertion connection between the baffle plate 4221 and the connecting plate 421.

In some embodiments of the present disclosure, the inserting buckle 4222*a* is provided on the connecting plate 421, and one side of the inserting bolt 4222*b* is provided on a side of the baffle plate 4221 (i.e., an adjacent side of the attachment side of the baffle plate 4221) and is inserted within the inserting buckle 4222*a*.

In some embodiments of the present disclosure, the inserting buckle 4222*a* is disposed on the baffle plate 4221, e.g., disposed on an upper or lower surface of the baffle plate 4221, and the inserting bolt 4222*b* may be disposed on the connecting plate 421 and inserted in the inserting buckle 4222*a* within.

In some embodiments of the present disclosure, the structure of the inserting component 4222 is simple and easy to implement, and it can ensure that the baffle plate 4221 can smoothly move in the direction of the center axis of the first articulating shaft 43, and at the same time, it can ensure that the baffle plate 4221 does not fall off during the movement (e.g., the baffle plate 4221 does not separate from the connecting plate 421 during the movement).

In some embodiments of the present disclosure, as shown in FIG. 7, each connecting structure 42 further includes two first side shields 423.

The first side shield 423 is a component for protecting the connecting mechanism 4 of the asymmetric hydraulic support. The first side shield 423 is provided as a rectangular-shaped plate-like structure.

In some embodiments of the present disclosure, two first side shields 423 are disposed on either side of a center axis of the articulating shaft (e.g., the second articulating shaft 44 and/or the first articulating shaft 43), with surfaces of the first side shields 423 being perpendicular to surfaces of the baffle plate 4221 (the surfaces of the two first side shields 423 are perpendicular to the surfaces of the baffle plate 4221), and each being coupled to an adjacent baffle plate 4221.

In some embodiments, the two first side shields 423 being disposed on either side of the center axis of the articulating shaft may include that: two first side shields 423 of the first connecting structure are fixedly disposed on the first side of the top mechanism 1 along either side of the center axis of the second articulating shaft 44 on the first side of the top mechanism 1 and extending to both sides of the center axis of the first articulating shaft 43, respectively, but not connected to the first articulating shaft 43. The two first side shields 423 of the second connecting structure are each fixedly disposed on both sides of the first side of the bottom mechanism 2 along the center axis of the second articulating shaft 44, and extend to both sides of the center axis of the first articulating shaft 43, respectively, but not connected to the first articulating shaft 43.

In some embodiments, the baffle plate 4221 adjacent to the first side shield 423 refers to both the first side shield 423 and the baffle plate 4221 being located on the same side of the top mechanism 1 on the first side along the center axis of the second articulating shaft 44, or both of them being located on the same side of the bottom mechanism 2 on the first side along the center axis of the second articulating shaft 44.

In some embodiments, the surfaces of the two first side shields 423 of each set of connecting structures 42 are perpendicular to the surfaces of each of the two baffle plates 4221, and each of the two first side shields 423 is connected to the adjacent baffle plate 4221, respectively, such that each first side shield 423 may be connected to the adjacent baffle plates 4221 to form an L-shaped structure.

The first side shield 423 is fixedly connected (e.g., being fixedly connected together by articulation, welding, etc.) to an adjacent baffle plate 4221 so that the first side shield 423 may be driven during movement of the baffle plate 4221.

In some embodiments of the present disclosure, the first side shield 423 is provided to be able to form an interior space with the connecting structure 42, thereby being able to protect the structure within the interior space from damage.

In some embodiments, the two sets of connecting structures 42 are symmetrically arranged with respect to a central axis of the respective corresponding second articulating shaft 44 as shown in FIG. 5. For example, the first connecting structure is symmetrically arranged with respect to the center axis of the second articulating shaft 44 to which the top plate 11 is articulated; and the second connecting structure is symmetrically arranged with respect to the center axis of the second articulating shaft 44 to which the bottom plate 21 is articulated.

In some embodiments of the present disclosure, the two sets of connecting structures 42 are symmetrically arranged with the center axis of the second articulating shaft 44, which facilitates the assembly and fabrication of the connecting structures 42 and the entire asymmetric hydraulic support 10.

In some embodiments, as shown in FIG. 1 and FIG. 2, the top mechanism 1 includes a top plate 11, a second side shield 12, and a first push-pull structure (not shown in the accompanying drawings).

The second side shield 12 is a component for protecting the top mechanism 1 of the asymmetric hydraulic support.

In some embodiments, the second side shield 12 is provided in an L-shape. As shown in FIG. 1, the second side shield 12 includes sub-panels disposed perpendicularly to each other, one sub-panel is disposed in parallel with a plate surface of the top plate 11, and the other sub-panel is perpendicular to a plate surface of the top plate 11. In a process of the movement of the second side shield 12, it is always maintained that there is no gap between the sub-plate and the top plate 11, which is able to ensure that the top mechanism 1 is free of seam, and that gangue may not fall into the internal space of the hydraulic mechanism.

In some embodiments, the top plate 11 is provided with a second side shield 12 on each side of the top plate 11 along the axial direction of the second articulating shaft 44, as shown in FIG. 1, FIG. 2. Each of the second side shields 12 is disposed with a first push-pull structure to enable movement of the second side shields 12 along both sides of the axial direction of the second articulating shaft 44 driven by the first push-pull structure. When the baffle plate 4221 is in motion and the top mechanism 1 is provided with the second side shields 12, the first side shields 423 and the second side shields 12 are able to remain parallel at all times.

The first push-pull structure is a component for pushing the second side shield closer to or further away from the adjacent asymmetric hydraulic support.

Figure 9:
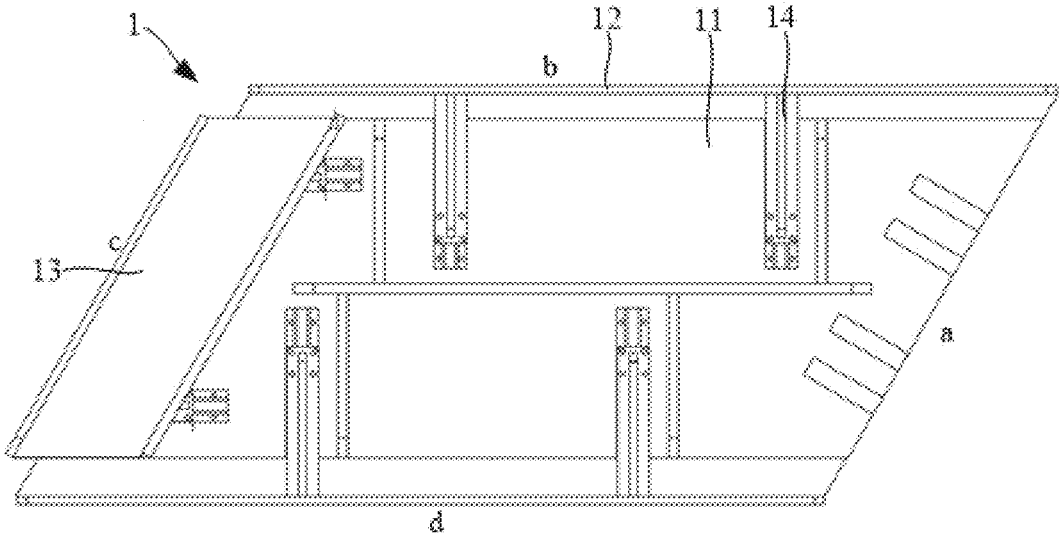
FIG. 9 is a schematic diagram illustrating a portion of a structure of a top mechanism according to some embodiments of the present disclosure.

In some embodiments, the first push-pull structure includes at least one set of guide slots 14 and at least one set of push-pull assemblies (not shown in the accompanying drawings), the guide slots 14 have the same number as the push-pull assemblies. The push-pull assembly may be a jack, a hydraulic cylinder, or the like. FIG. 9 is a schematic diagram illustrating a structure of the first push-pull structure including two sets of guide slots 14. In some embodiments, the guide slots 14 are guided in a direction parallel to the side a or the side c of the parallelogram projected by the top mechanism 1 on the working surface 60, or perpendicular to the side b or side d of the parallelogram projected by the top mechanism 1 on the working surface 60, and a guiding direction of the guide slots 14 determines the second side shield 12 push-out path.

According to some embodiments of the present disclosure, the second side shields 12 of the top mechanism 1 are capable of forming an interior space with the top plate 11, which is capable of protecting the structure within the interior space from damage. A first push-pull structure configured for each of the second side shields 12 ensures that the second side shields 12 are driven by the first push-pull structure to move on both sides of the top plate 11, so that when the plurality of asymmetric hydraulic supports 10 are set up in a straight-line, if there is a gap between two adjacent asymmetric hydraulic supports 10, the second side shield 12 may move to reduce the gap between the two asymmetric hydraulic supports 10, which greatly improves the adaptability between the two adjacent asymmetric hydraulic supports 10, and is conducive to the support of the working surface by the asymmetric hydraulic supports 10.

In some embodiments, due to dislodged broken coal, gangue, and other debris may fall into the gap between the second side shield 12 and the top plate 11, resulting in an increase in the resistance of the first push-pull structure to push the second side shield 12, or even causing the second side shield 12 to be completely jammed. A friction-reducing component may be installed between the second side shield 12 and the top plate 11.

In some embodiments, as shown in FIG. 1 and FIG. 2, the top mechanism 1 further includes a face shield 13 and a second push-pull structure (not shown in the accompanying drawings).

The face shield 13 is a component for limiting the movement of the top plate and preventing the top plate from collapsing. The face shield 13 may be rectangular in shape.

In some embodiments, the top mechanism 1 is provided with the face shield 13 on the opposing side of the setting of the first articulating shaft 43 (i.e., the opposing side of the first side, which may also be referred to as the second side of the top mechanism 1). For example, the face shield 13 is provided on the side c of a parallelogram projected by the top mechanism 1 on the working surface.

The second push-pull structure is connected to the face shield 13 to enable movement of the face shield 13 driven by the second push-pull structure, e.g., to cause the face shield 13 to be moved in a direction proximate the first side or away from the first side.

The second push-pull structure is a component that pushes the face shield 14 closer to or away from the first side.

In some embodiments, the second push-pull structure includes at least one set of rails (not shown in the accompanying drawings) and at least one set of push-pull assemblies (not shown in the accompanying drawings), the rails and the push-pull assemblies are the same in number. The push-pull assembly may be a jack, a hydraulic cylinder, or the like. FIG. 9 is a schematic diagram illustrating a structure of the second push-pull structure including two sets of guide slots. In some embodiments, the guide rails are oriented in a direction parallel to the side b or the side d of the parallelogram projected by the top mechanism 1 on the working surface, or perpendicular to the side a or side c of the parallelogram projected on the working surface of the top mechanism 1, and a guiding direction of the guide rail determines the second side shield 12 push-out path.

In some embodiments of the present disclosure, by additionally providing a rectangular face shield 13 at the top mechanism 1, it is possible to form an interior space with the top plate 11 and the second side shield 12, which is able to protect the structure within the interior space from damage.

In some embodiments, the center axis of the telescopic structure 41 makes an angle of less than or equal to 90° with the bottom surface of the bottom mechanism 2.

Exemplarily, the angle between the center axis of the telescopic structure 41 and the bottom surface of the bottom mechanism 2 is equal to 90°, which facilitates the setup and fabrication of the telescopic structure 41, and the telescopic mechanism 3 drives the top mechanism 1 to do a rising or a falling motion relative to the bottom mechanism 2, i.e., with the asymmetric hydraulic support 10 rising, the connecting mechanism 4 moves to the right side of the asymmetric hydraulic support 10, and with the asymmetric hydraulic support 10 falling, the connecting mechanism 4 moves to the left side of the asymmetric hydraulic support 10.

In some embodiments, the center axis of the telescopic mechanism 3 makes an angle of less than or equal to 90° with the bottom surface of the bottom mechanism 2. For example, when the telescopic mechanism 3 includes two jacks, the angle between the center axis of each jack and the bottom surface of the bottom mechanism 2 is less than or equal to 90°, which enables the telescopic mechanism 3 to drive the top mechanism 1 relative to the bottom mechanism 2 in a smoother upward or downward movement.

FIG. 3 is a schematic diagram illustrating an upper portion of the asymmetric hydraulic support 10 being a structure when the top mechanism 1 is descending while the lower portion of the asymmetric hydraulic support 10 being a structure when the top mechanism 1 is ascending. As shown in FIG. 3, when the top mechanism 1 of the asymmetric hydraulic support 10 descends, an outstretched distance of the two sets of connecting mechanisms 4 toward the side of the goaf 50 increases, the inserting buckles 4222*a* in the plurality of inserting components 4222 in one of the connecting structure 42 move relative to each other in a direction toward the connection of the inserting bolts 4222*b* with the baffle plate 4221, and the inserting buckles 4222*a* in the plurality of inserting components 4222 in the other shelter assembly move relative to the inserting bolts 4222*b* away from the connection with the baffle plate 4221.

In some embodiments, when the angle between the center axis of the telescopic structure 41 and the bottom surface of the bottom mechanism 2 is less than 90°, the center axis of the telescopic mechanism 3 is tilted toward the front end of the top mechanism 1. The front end of the top mechanism 1 is the end of the top mechanism 1 proximate the face shield 13.

In some embodiments of the present disclosure, when the angle between the center axis of the telescopic structure 41 and the bottom surface of the bottom mechanism 2 is less than or equal to 90°, it can be made more convenient to set up and fabricate the telescopic structure 41, and at the same time, the connecting mechanism 4 may not make swaying movement relative to the bottom mechanism 2 when the telescopic mechanism 3 drives the top mechanism 1 up or down, thereby improving the overall structural stability of the asymmetric hydraulic support 10.

As shown in FIG. 1 and FIG. 2, in some embodiments, the bottom mechanism 2 includes a bottom plate 21, a third side shield 22, and a third push-pull structure. The bottom plate 21 is provided with a third side shield 22 on each side of the axial direction of the second articulating shaft 44. Each third side shield 22 is equipped with a third push-pull structure (not shown in the accompanying drawings) to enable movement of the third side shield 22 on either side of the bottom plate 21 driven by the third push-pull structure.

The third side shield 22 is a component for protecting the bottom mechanism 2 of the asymmetric hydraulic support. The third side shield 22 may be a rectangular-shaped plate-like structure, or the like.

The third push-pull structure is configured to actuate the third side shield 22 for movement. The third push-pull structure drives the third side shield 22 in a direction perpendicular to the center axis of the articulating shaft (e.g., the first articulating shaft 43 or the second articulating shaft 44). For example, a path of movement may be parallel to the side a or the side c of the parallelogram, or perpendicular to the side b or the side d.

The third push-pull structure is similar to the first push-pull structure and the second push-pull structure, more descriptions of the third push-pull structure may be found in the previous related descriptions.

In some embodiments, when the asymmetric hydraulic support 10 provided in the embodiments of the present disclosure is used for support, the racks are moved upwardly from the lower portion of the working surface 60 in sequence, which is conducive to preventing backward sliding of the asymmetric hydraulic support 10, and due to the particularity of the parallelogram, if there is a counter-rail working surface, it is necessary to manufacture the asymmetric hydraulic support 10 symmetrically. The asymmetric hydraulic support 10 of the embodiment of the present disclosure should be manufactured symmetrically if there is an opposing working surface, which is also applicable to the opposing working surface.

In some embodiments of the present disclosure, the internal space formed by the third side shield 22 and the bottom plate 21 can effectively protect the internal structure from damage; the third side shield 22 can be driven by the third push-pull structure to move on both sides of the bottom plate 21, and the movement path can be parallel or perpendicular to the sides of the parallelogram, which increases the flexibility and adaptability of the mechanism; and the asymmetric hydraulic support 10 is not only suitable for working surfaces but also suitable for pulling working surfaces through symmetrical fabrication, which helps to enhance the versatility and applicability range of the asymmetric hydraulic support.

In some embodiments, in order to avoid the occurrence of phenomena such as bracket tail sliding (i.e., tail slip) or shifting space of the asymmetric hydraulic support from occurring, an anti-slip component, such as an anti-slip bottom pad having a concave-convex texture, is mounted to a lower surface of the bottom plate 21 of the bottom mechanism 2, to increase the friction between the asymmetric hydraulic support and the seam.

Figure 12:
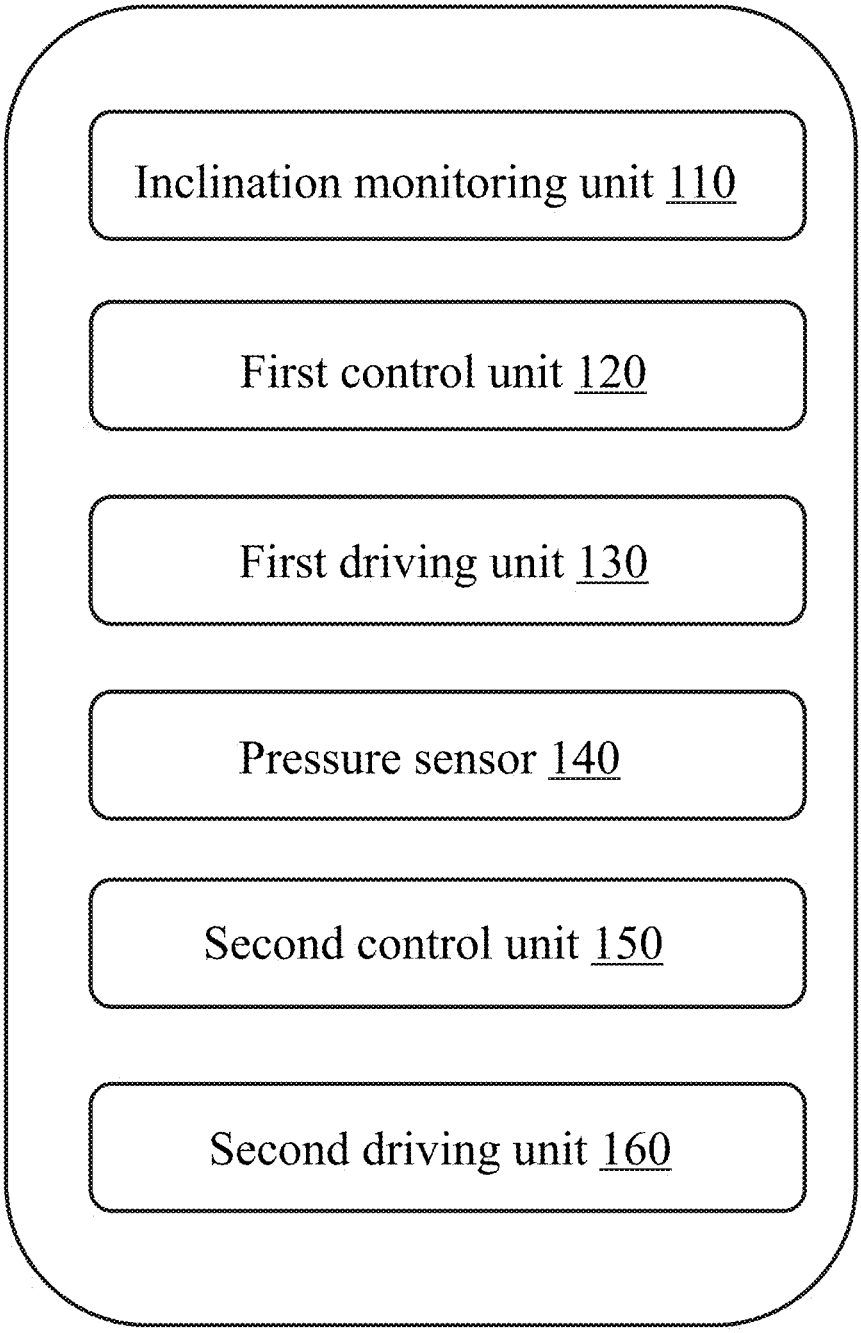
FIG. 12 is a module diagram illustrating a single asymmetric hydraulic support for pseudo inclined mining in steeply dipping seam according to some embodiments of the present disclosure.

FIG. 12 is a module diagram illustrating a single asymmetric hydraulic support for pseudo inclined mining in steeply dipping seam according to some embodiments of the present disclosure. As shown in FIG. 12, a control system includes an inclination monitoring unit 110, a first control unit 120, and a first driving unit 130.

The first control unit 120 is a device for controlling the first driving unit 130.

In some embodiments, the first control unit 120 is configured to: in response to an angular change value of a steeply dipping angle $\gamma$ exceeding an angular change threshold, control the first driving unit 130 to drive the asymmetric hydraulic support to adjust an acute angle $\alpha$ of the projected shape of the asymmetric hydraulic support on the working surface (i.e., the parallelogram as described in the previous section). More descriptions of the steeply dipping angle $\gamma$, the acute angle $\alpha$, and asymmetric hydraulic support may be found in the relevant descriptions of FIG. 1, FIG. 2, and FIG. 11.

In some embodiments, the first control unit 120 includes a first processor, a first memory, and a first communication device. The first processor is configured to determine whether to adjust the acute angle $\alpha$ of the projected shape of the asymmetric hydraulic support on the working surface. In some embodiments, the first processor may include, but is not limited to, a central processing unit (CPU), a field programmable gate array (FPGA), or the like. The first memory is a device for storing data. In some embodiments, the data stored in the first memory includes pre-stored computer commands, angular change thresholds, records of adjustments to monitored steeply dipping angles $\gamma$, acute angles $\alpha$, or the like. The first communication device is communicatively coupled with the inclination monitoring unit and the first driving unit to be responsible for information transmission.

The first driving unit 130 is configured to actuate the telescopic mechanism to retract. In some embodiments, the first driving unit 130 includes a motor. The first driving unit 130 adjusts a magnitude of the acute angle $\alpha$ by adjusting a length of the jacks or hydraulic columns in the telescopic mechanism. More description of the telescopic mechanism may be found in the relevant descriptions of FIG. 1 and FIG. 2.

At least one first control unit and at least one first driving unit are provided at each asymmetric hydraulic support.

The inclination monitoring unit 110 is a measuring device for obtaining an angular value of the steeply dipping angle γ. In some embodiments, the inclination monitoring unit 110 may include a gyroscope, a level, or the like. The inclination monitoring unit 110 is mounted on an asymmetric hydraulic support where a steeply dipping angle needs to be measured.

In the actual coal mining process, a position of the asymmetric hydraulic support may be constantly moved and adjusted. For example, after coal mining is completed at the current location, the asymmetric hydraulic support is advanced to the remaining locations and refixing is completed. Whenever the position of the asymmetric hydraulic support is re-fixed, the inclination monitoring unit obtains a value of the steeply dipping angle γ of the asymmetric hydraulic support at the current position.

In some embodiments, the first control unit 120 communicates with the inclination monitoring unit 110 in real time to obtain monitoring data (including the steeply dipping angle γ) of the inclination monitoring unit 110, and determines an angular change value of the steeply dipping angle γ in real time. When the angular change value of the steeply dipping angle γ exceeds an angular change threshold, the first control unit 120 controls the first driving unit 130 to drive the asymmetric hydraulic support to adjust an acute angle of the top mechanism with the projection of the parallelogram of the bottom mechanism on the working surface α.

The angular change value of the steeply dipping angle γ may reflect the change in the steeply dipping angle γ. In some embodiments, the angular change value of the steeply dipping angle γ may be expressed as a difference between a current angle of the steeply dipping angle γ and a previous angle of the steeply dipping angle γ.

The angular change threshold is a judgment threshold for determining whether an adjustment of the acute angle α is required. In some embodiments, the angular change threshold is obtained based on an a priori empirical preset.

In some embodiments, the first control unit 120 is configured to determine an angular change threshold based on the current steeply dipping angle γ by querying a first preset table.

The first preset table includes a correspondence between a plurality of reference steeply dipping angles γ and a plurality of reference angular change thresholds.

In some embodiments, the first preset table is obtained by the remote server pre-built based on historical mining record.

The historical mining record is a mining record of a historically mined seam. In some embodiments, the historical mining record includes a steeply dipping angle γ before the move, a steeply dipping angle γ after the move, an angular change value of the steeply dipping angle γ before and after the move when the single asymmetric hydraulic support was mined in a single pass, whether an adjustment of the acute angle α is performed, and the angular change value of the steeply dipping angle γ when the acute angle α is adjusted.

The remote server is a server used to perform complex computational processing, such as cloud processors.

The remote server may communicate with the first control unit 120 via the first communication device. The remote server is required to perform the construction and updating of the first preset table because the computational power of the first processor of the first control unit 120 is usually weak and difficult to complete more complex operations.

In some embodiments, the remote server may screen a number of historical mining records stored in the first memory to identify those of the historical mining records in which the angle of acute angle α has not been adjusted as target mining records. For the target mining records with the same steeply dipping angle γ after the move, the remote server may take the angular change value with the largest value therein as the angular change threshold corresponding to the steeply dipping angle γ, thereby determining the angular change thresholds corresponding to different steeply dipping angles γ, completing the construction of the first preset table.

In some embodiments, when the first preset table is constructed, the remote server may transmit the first preset table to the first control unit 120.

In some embodiments, at the end of each mining process, the remote server may also update the first preset table based on the most recent mining record corresponding to that mining. For example, the first control unit 120 of the respective asymmetric hydraulic support may upload the latest mining record in the first memory to the remote server via the first communication device, and the remote server may update, based on the latest mining record, the first preset table, sending the updated first preset table to the first control unit 120 of the respective asymmetric hydraulic support. The operations of updating the first preset table based on the latest mining record are similar to the operations of constructing the first preset table based on historical mining records, as may be seen in the relevant content above.

In some embodiments, in response to the presence of the manual adjustment data in the latest mining record, the remote server may identify the manual adjustment data from the latest mining record and update the first preset table based on the manual adjustment data.

The manual adjustment data is adjustment data that the user manually adjusts the acute angle α. The user manually adjusting the acute angle α indicates that the angular change threshold corresponding to the steeply dipping angle γ in the current first preset table is not applicable to the current actual situation, and therefore, the first preset table needs to be updated.

In some embodiments, the remote server may identify the target value of the acute angle α manually entered by the user in the latest mining record as the manual adjustment data.

In some embodiments, the remote server may add the manual adjustment data to the historical mining record, obtain an updated historical mining record, and update the first preset table based on the updated historical mining record. The operations of updating the first preset table based on the updated historical mining record are similar to the operations of constructing the first preset table based on the above described, as may be seen in connection above.

In some embodiments, the remote server may also construct the first preset table based on the alignment degree in the historical mining records. Correspondingly, the first control unit 120 may determine an angular change threshold by querying the first preset table based on the current steeply dipping angle γ and the current alignment degree.

The alignment degree may reflect an alignment degree between two neighboring asymmetric hydraulic supports. In some embodiments, the alignment degree may be expressed as a numerical value, or the like. The smaller the alignment degree, the more offset the two neighboring asymmetric hydraulic supports are from each other, and the larger the alignment degree, the more the two neighboring asymmetric hydraulic supports are fully aligned with each other.

In some embodiments, the remote server may determine an alignment degree between two neighboring asymmetric hydraulic supports based on an angle between the second side shields of the two asymmetric hydraulic supports. For example, the alignment degree reaches a maximum when the angle between the second side shields of the two neighboring asymmetric hydraulic supports is 0 degrees; the larger the angle, the more severe the deviation between the two neighboring asymmetric hydraulic supports, and the smaller the alignment degree.

In some embodiments, the remote server may determine that the alignment degree of the plurality of asymmetric hydraulic supports at the time of the historical mining is stored into the historical mining record and construct a first preset table based on the historical mining record containing the alignment degree. The remote server may filter the plurality of historical mining records to identify one of the historical mining records in which the acute angle $\alpha$ has not been adjusted and the alignment degree is greater than the preset alignment threshold as a target mining record. For the target mining records with the same steeply dipping angle $\gamma$ after the move, the remote server may take the angular change value with the largest value therein as the angular change threshold corresponding to the steeply dipping angle $\gamma$, thereby determining the angular change thresholds corresponding to different steeply dipping angles $\gamma$, completing the construction of the first preset table.

For the target mining records with the same steeply dipping angle $\gamma$ after the move, the remote server may take the angular change value with the largest value therein as the angular change threshold corresponding to the steeply dipping angle $\gamma$, thereby determining the angular change thresholds corresponding to different steeply dipping angles $\gamma$, completing the construction of the first preset table.

In some embodiments, the angular change threshold is also correlated to an endowment morphology feature, a mineral feature, and a gangue feature of current seam.

The endowment morphology feature is a characteristic associated with the distribution of a seam in a geological formation. In some embodiments, the endowment morphology feature may include the seam thickness and seam dip angle.

The mineral feature is characteristic associated with minerals in a coal mine. In some embodiments, the mineral feature may include the type and content of the mineral, for example (10% silicate, 5% sulfate). The higher the mineral content, the worse the quality of the coal mine.

The gangue feature may reflect whether or not a non-coal rock layer is interspersed in the seam. In some embodiments, the non-coal rock layers may include mudstone, claystone, sandstone, or the like, and it is more difficult to mine the seam when the seam are interspersed with non-coal rock layers.

In some embodiments, the remote server may obtain the endowment morphology feature, the mineral feature, the gangue feature of the seam may be obtained based on information such as the survey report of the seam.

In some embodiments of the present disclosure, factors such as the endowment morphology feature, mineral feature, gangue feature, and other factors of the current seam are also included when constructing the first preset table, which allows for a comprehensive consideration of the influence of the different seam on the angular change threshold value, and helps to improve the accuracy when determining the angular change threshold, thereby ensuring reliability when adjusting the acute angle $\alpha$.

In some embodiments, a telescopic second guard is also mounted on the second side shield 12 of the asymmetric hydraulic support 10. The telescopic second guard extends along the left and right sides of the second side shield, i.e., the telescopic second guard may be located closer to or further away from the first side, thereby selectively extending the lengths of the side b and side d of the parallelogram. The side of the two telescopic second guards near the face shield is connected to the face shield 13, and the side away from the face shields may be mechanically connected by a connecting rod. The length of the connecting rod is the same as the length of the face shield, and the projection of the connecting rod on the working surface is parallel to the projection of the face shield 13 on the working surface. With the second side shield 12 with the telescopic second guard, the face shield 13, and the connecting rod, a parallelogram with an adjustable acute angle $\alpha$ may be formed.

The first control unit 120 may adjust the acute angle $\alpha$ in various ways. For example, the two sets of push-pull assemblies of the second push-pull structure may be subjected to asynchronous movement, i.e., the two sets of push-pull assemblies do not have the same displacement distance. At this time, the two telescopic second guards, and the connecting rod, are affected by the face shield 13 and are displaced without destroying the structure of the parallelogram, and the angle of the acute angle $\alpha$ is adjusted. The first control unit 120 may, through the geometric relationship, determine a target displacement distance of the two sets of push-pull assemblies in the second push-pull structure based on the target value of the acute angle $\alpha$ and send it to the second push-pull structure so that the acute angle $\alpha$ reaches the target value.

In some embodiments of the present disclosure, the inclination monitoring unit 110 acquires the angle value of the steeply dipping angle $\gamma$ in real time, and when the angle change exceeds an angular change threshold, the first control unit 120 automatically controls the first driving unit 130 in accordance with the value of the inclination change, to realize real-time dynamic adjustment of the asymmetric hydraulic support, improves the response speed and adjustment precision of the asymmetric hydraulic support, and helps improve the safety and stability of the working surface.

In some embodiments, the control system further includes a pressure sensor 140, a second control unit 150, and a second driving unit 160, as shown in FIG. 12.

The second control unit 150 is a device for controlling the second driving unit 160. In some embodiments, the second control unit 150 may include a second processor, a second memory, and a second communication device. In which the second processor is used to determine whether to actuate the second push-pull structure. In some embodiments, the data stored in the second memory may include pre-stored computer instructions, preset conditions, preset pressure thresholds, preset alignment conditions, and the like. The second communication device is communicatively coupled to the pressure sensor and the second driving unit to be responsible for the transmission of information.

The second driving unit 160 is configured to drive the device of the first push-pull structure. The second driving unit 160 is similar to the first driving unit 130, and more description may be found in the description related to the first driving unit above.

In some embodiments, the pressure sensor 140 is disposed on a second side shield of the top structure. For example, the pressure sensor 140 is disposed within an indentation in a side surface of the second side shield 12.

In some embodiments, the count of pressure sensors 140 may be a plurality which is distributed on a side surface of the second side shield 12.

The pressure sensor 140 may be configured to obtain pressure data between two adjacent asymmetric hydraulic supports. The pressure data may reflect a pressure value between two adjacent asymmetric hydraulic supports.

In some embodiments, when a ball of the side surface of the second side shield 12 of two adjacent asymmetric hydraulic supports coincides with an indentation, the pressure sensor 140 may detect a pressure of the ball embedded within the indentation. Whereas, when there is a gap or it is not aligned between two adjacent asymmetric hydraulic supports, the balls of the side surface of the second side shields 12 of the asymmetric hydraulic supports do not fit into the indentations, and the pressure sensor 140 is not able to detect the pressure with which the balls are embedded within the indentation. As a result, the pressure data from the pressure sensor 140 may reflect whether or not two adjacent asymmetric hydraulic supports are aligned with each other.

In some embodiments, the second control unit 150 is configured to: determine whether or not the pressure data satisfies a preset condition; and in response to the pressure data not satisfying the preset condition, control the second driving unit to drive the first push-pull structure.

The preset condition is configured to determine whether conditions are required to actuate the first push-pull structure. In some embodiments, the preset condition may include a preset pressure condition.

The preset pressure condition is a judgment condition for determining whether the pressure between two adjacent asymmetric hydraulic supports is normal. In some embodiments, the preset pressure condition includes pressure data being greater than a preset pressure threshold. In some embodiments, the preset pressure condition further includes the pressure data being within a preset pressure range. The preset pressure threshold and the preset pressure range may be set based on historical experience. The preset pressure threshold and the preset pressure range may also be determined based on actual application scenarios and needs.

In some embodiments, the preset conditions further include a preset alignment condition. The second control unit 150 may determine, based on the pressure data from the plurality of pressure sensors 140, the alignment degree between adjacent asymmetric hydraulic supports via the alignment model, and determine whether the alignment degree satisfies the preset alignment condition.

The preset alignment condition is a judgment condition for determining whether two adjacent asymmetric hydraulic supports are evenly aligned with each other. In some embodiments, the preset alignment condition may include the alignment degree greater than a preset alignment threshold, and the preset alignment threshold may be determined based on historical experience.

The alignment degree may be obtained in a number of ways. For example, it is obtained by an alignment model. In some embodiments, the second control unit determines, based on the pressure data of the plurality of pressure sensors, an alignment degree between two adjacent asymmetric hydraulic supports by the alignment model, and determines whether the alignment degree satisfies a preset alignment condition.

The alignment model is a predictive model for determining a contrast between two adjacent asymmetric hydraulic supports. In some embodiments, the alignment model may be a machine learning model, such as one or a combination of RNN (recurrent neural network) or other customized model structures.

In some embodiments, inputs to the alignment model include the installation location of each pressure sensor of the plurality of pressure sensors and pressure data monitored thereof, endowment morphology feature of the current seam, mineral feature, and gangue feature, and outputs of the alignment model include the alignment degree. More descriptions of the endowment morphology feature, the mineral feature, the gangue feature, and the alignment degree of the current seam may be found in the description above.

The alignment model may be obtained by training a large number of training samples with labels. In some embodiments, the training samples may include sample installation locations of the sample pressure sensors and sample pressure data, sample endowment morphology features of the sample seam, sample mineral feature, and sample entrapment gangue feature. The label may be the sample alignment degree corresponding to the training sample.

In some embodiments, the training samples, and the labels, may be obtained through historical data or field trials. For example, in an actual mining scenario, the second control unit 150 may be configured to bring two adjacent asymmetric hydraulic supports side-by-side, obtain pressure data from the plurality of pressure sensors 140 after their side-by-side proximity, and the endowment form feature, the mineral feature, and the gangue feature of the current seam are used as training samples, and the second control unit 150 may measure the angle between the second side shields and determine the alignment degree, which is used as the label corresponding to the training samples and sent to a remote server. A number of sets of training samples with labels may be obtained by repeating the above method of leaning against two neighboring asymmetric hydraulic supports side by side several times in different attitudes.

The training process for the alignment model may be performed in a remote server. The remote server may perform the following training process to obtain the scanning feature prediction model. The training process includes obtaining multiple training samples with labels to form a training sample set and performing multiple rounds of iterations based on the training sample set. The at least one round of iteration includes: selecting one or more training samples from the training dataset, inputting the one or more training samples into the initial alignment model, obtaining a model prediction output corresponding to the one or more training samples; substituting the model prediction output corresponding to the one or more training samples, and the labels corresponding to the one or more training samples, into a formula for a predefined loss function, calculating a value of the loss function; and iteratively updating the model parameters in the initial alignment model according to the value of the loss function until an iteration end condition is satisfied, ending the iteration, and obtaining the trained alignment model. The iterative updating of the model parameters of the initial alignment model may be carried out by a variety of processes, e.g., it may be carried out based on the gradient descent process. The iteration end conditions may include the loss function converging or the number of iterations reaching an iteration count threshold, etc.

After the training of the alignment model is completed, the remote server may send the trained alignment model to the second processor of the second control unit 150.

In some embodiments of the present disclosure, by using the alignment model to determine the alignment degree between adjacent asymmetric hydraulic supports, the data processing capability of the model and the data analyzing capability can be fully utilized to obtain an accurate and reliable alignment degree in a short time. It helps to quickly and accurately determine whether adjacent asymmetric hydraulic supports are aligned.

In some embodiments, when the pressure data of two adjacent asymmetric hydraulic supports do not satisfy the preset pressure condition or the alignment degree does not satisfy the preset alignment condition, it may be considered that the preset condition is not satisfied. At this time, the second control unit 150 may control the second driving unit 160 to drive the first push-pull structure for adjustment until the preset condition is satisfied.

In some embodiments, the second control unit 150 may control the second driving unit 160 to drive adjustments to the first push-pull structure in various ways. For example, the second control unit 150 may control the second driving unit 160 to slowly drive the first push-pull structure at a predetermined speed so that the second side shield 12 of the asymmetric hydraulic support is gradually moved closer to or further away from the neighboring asymmetric hydraulic support, while continuously obtaining pressure data from the pressure sensor, and stopping driving the first push-pull structure when the pressure data satisfies the preset pressure condition.

The preset speed is a predetermined speed at which the first push-pull structure moves. In some embodiments, the preset speed may be related to pressure data and a preset pressure threshold. For example, the preset speed may be positively correlated to a difference between the pressure data and the preset pressure threshold, with a larger difference resulting in a faster preset speed and a smaller difference resulting in a smaller preset speed.

In some embodiments of the present disclosure, by determining whether two adjacent asymmetric hydraulic supports satisfy a preset condition, and when the preset condition is not satisfied, by adjusting the first push-pull structure so that the two adjacent asymmetric hydraulic supports are aligned, the automated adjustment of the asymmetric hydraulic support can be realized, which can improve the adjustment efficiency and stability of the asymmetric hydraulic support.

It should be noted that the above descriptions are merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures, or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or collocation of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "unit," "module," or "system." Furthermore, aspects of the present disclosure may take the form of a computer program product embodied in one or more computer readable media having computer-readable program code embodied thereon.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

In some embodiments, numbers describing the number of ingredients and attributes are used. It should be understood that such numbers used for the description of the embodiments use the modifier "about", "approximately", or "substantially" in some examples. Unless otherwise stated, "about", "approximately", or "substantially" indicates that the number is allowed to vary by ±20%. Correspondingly, in some embodiments, the numerical parameters used in the description and claims are approximate values, and the approximate values may be changed according to the required characteristics of individual embodiments. In some embodiments, the numerical parameters should consider the prescribed effective digits and adopt the method of general digit retention. Although the numerical ranges and parameters used to confirm the breadth of the range in some embodiments of the present disclosure are approximate values, in specific embodiments, settings of such numerical values are as accurate as possible within a feasible range.

For each patent, patent application, patent application publication, or other materials cited in the present disclosure, such as articles, books, specifications, publications, documents, or the like, the entire contents of which are hereby incorporated into the present disclosure as a reference. The application history documents that are inconsistent or conflict with the content of the present disclosure are excluded, and the documents that restrict the broadest scope of the claims of the present disclosure (currently or later attached to the present disclosure) are also excluded. It should be noted that if there is any inconsistency or conflict between the description, definition, and/or use of terms in the auxiliary materials of the present disclosure and the content of the present disclosure, the description, definition, and/or use of terms in the present disclosure is subject to the present disclosure.

Finally, it should be understood that the embodiments described in the present disclosure are only used to illustrate the principles of the embodiments of the present disclosure. Other variations may also fall within the scope of the present disclosure. Therefore, as an example and not a limitation, alternative configurations of the embodiments of the present disclosure may be regarded as consistent with the teaching of the present disclosure. Accordingly, the embodiments of the present disclosure are not limited to the embodiments introduced and described in the present disclosure explicitly.

What is claimed is:

1. An asymmetric hydraulic support for pseudo inclined mining in steeply dipping seam, wherein the asymmetric hydraulic support includes a top mechanism, a bottom mechanism, a telescopic mechanism, and a connecting mechanism; wherein the top mechanism and the bottom mechanism are disposed in parallel to each other, the top mechanism includes a top plate in a shape of a parallelogram, the bottom mechanism includes a bottom plate in a shape of a parallelogram, and a projection of the top mechanism on a working surface and a projection of the bottom mechanism on the working surface are two parallelograms, and a sum of an acute angle of each of the two parallelograms and a steeply dipping angle in pseudo inclined mining is 90°;

the telescopic mechanism is provided between the top mechanism and the bottom mechanism, and two ends of the telescopic mechanism are rotationally connected to the top mechanism and the bottom mechanism, respectively;

the connecting mechanism includes a telescopic structure and two sets of connecting structures, the two sets of connecting structures include a first connecting structure and a second connecting structure;

one end of each of the first connecting structure and the second connecting structure is hinged by a first articulating shaft, and a central axis of the first articulating shaft is located in a middle of the top mechanism and the bottom mechanism, and the other end of the each of the first connecting structure and the second connecting structure is hinged to a first side of the top mechanism and a first side of the bottom mechanism, respectively, by a second articulating shaft;

each of the two sets of connecting structures includes a connecting plate and two sets of shelter assemblies, each set of the two sets of shelter assemblies includes a baffle plate and a plurality of inserting components;

the plurality of inserting components is arranged on one side of the baffle plate;

the two sets of shelter assemblies are arranged on a surface of the connecting plate, two baffle plates in the two sets of shelter assemblies are arranged on two sides of the first articulating shaft, and a side of one of the two baffle plates on which the inserting components are set is adjacent to the side of the other of the two baffle plates on which the inserting components are set, so that when the two sets of the connecting structures are rotated relative to each other, the two baffle plates move in a direction of the center axis of the first direction, to make the two baffle plates and the connecting plate have no gaps and a sum of a width of the connecting plate and widths of the two baffle plates along a direction of the center axis of the first articulating shaft is adapted to a width of the top mechanism; and one end of the telescoping structure is hinged to the first connecting structure which is hinged to the top mechanism, the other end of the telescoping structure is hinged to the bottom mechanism, and a center point of the hinging is coplanar with a vertical bisector of a projection of an edge of the first side of the bottom mechanism on the working surface.

2. The asymmetric hydraulic support of claim 1, wherein each of the plurality of inserting components includes an inserting buckle and an inserting bolt;

the inserting bolt is in a shape of a circular arc, and a shape of an inner hole of the insertion buckle is adapted to a shape of the inserting bolt; and the inserting buckle is arranged on the connecting plate, and one side of the insertion bolt is arranged on a side surface of the baffle plate and is inserted within the inserting buckle.

3. The asymmetric hydraulic support of claim 2, wherein the each of the two sets of connecting structures further includes two first side shields;

the two first side shields are respectively arranged on two sides of at least one of the first articulating shaft and the second articulating shaft, a surface of each of the two first side shields is perpendicular to a surface of the baffle plate, and the two first side shields are connected to adjacent baffle plates, respectively.

4. The asymmetric hydraulic support of claim 1, wherein the two sets of connecting structures are symmetrically disposed with a central axis of the second articulating shaft as an axis of symmetry.

5. The asymmetric hydraulic support of claim 1, wherein the top mechanism further includes one or more second side shields and a first push-pull structure;

each of two sides of the top plate is arranged with a second side shield on each side along an axial direction of the second articulating shaft; and each of the one or more second side shields is provided with a first push-pull structure to enable a movement of each of the one or more second side shields on the two sides of the top plate driven by the first push-pull structure.

6. The asymmetric hydraulic support of claim 1, wherein the top mechanism further includes a face shield and a second push-pull structure;

the face shield is arranged on a side of the top mechanism opposite to the first articulating shaft; and the second push-pull structure is connected to the face shield to enable a movement of the face shield driven by the second push-pull structure.

7. The asymmetric hydraulic support of claim 1, wherein an angle between a central axis of the telescopic structure and a bottom surface of the bottom mechanism is less than or equal to 90°.

8. The asymmetric hydraulic support of claim 1, wherein the telescopic structure is a hydraulic cylinder.

9. The asymmetric hydraulic support of claim 1, wherein the bottom mechanism further includes one or more third side shields and a third push-pull structure;

each of two sides of the bottom plate is arranged with a third side shield along an axial direction of the second articulating shaft, respectively; and each of the one or more third side shields is arranged with the third push-pull structure to enable a movement of each of the one or more third side shields on the two side of the bottom plate driven by the third push-pull structure.

* * * * *